United States Patent [19]

Inoue et al.

[11] Patent Number: 4,871,653

[45] Date of Patent: Oct. 3, 1989

[54] PROCESS FOR FORMING DIRECT-POSITIVE IMAGE

[75] Inventors: Noriyuki Inoue; Tatsuo Heki; Tetsuro Kojima, all of Kanagawa, Japan

[73] Assignee: Fuji Photo Film Co., Ltd., Kanagawa, Japan

[21] Appl. No.: 67,850

[22] Filed: Jun. 30, 1987

[30] Foreign Application Priority Data

Jun. 30, 1986 [JP] Japan ..... 61-153481

[51] Int. Cl.[4] ..... G03C 1/485; G03C 5/24

[52] U.S. Cl. ..... 430/409; 430/410; 430/598; 430/567; 430/940

[58] Field of Search ..... 430/409, 410, 598, 940, 430/567

[56] References Cited

U.S. PATENT DOCUMENTS

| | | | |
|---|---|---|---|
| 4,268,621 | 5/1981 | Ogi et al. | 430/409 |
| 4,358,528 | 11/1982 | Takagi et al. | 430/614 |
| 4,374,923 | 2/1983 | Hirano et al. | 430/598 |
| 4,481,285 | 11/1984 | Takagi et al. . | |
| 4,550,070 | 10/1985 | Miyasaka et al. . | |
| 4,551,419 | 11/1985 | Sugimoto et al. | 430/611 |

OTHER PUBLICATIONS

Research Disclosure 16135, Sep. 1977.

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A process for forming a direct-positive image by developing an imagewise exposed photosensitive material, having on a support at least one photographic emulsion layer containing nonprefogged silver halide grains capable of forming an internal latent image, in which development is carried out in the presence of a combination of a nucleating agent and at least one compound having at least one mercapto group selected from a tetrazaindene, a triazaindene, and a pentaazaindene. The hydrogen atom of which mercapto group may optionally be further substituted with an alkali metal atom or an ammonium group. The invention process provides rapid and consistent formation of direct-positive images having high maximum density and low minimum density.

6 Claims, No Drawings

PROCESS FOR FORMING DIRECT-POSITIVE IMAGE

FIELD OF THE INVENTION

The present invention relates to a process for forming a direct-positive image by subjecting an imagewise exposed direct-positive silver halide photographic material to development-processing in the presence of a nucleating agent.

BACKGROUND OF THE INVENTION

Photographic processes for producing direct-positive images without requiring a reversal processing step or a negative film are well known.

With the exception of those using special materials, methods commonly used for producing positive images employing known direct-positive silver halide photographic materials can be divided generally into two types on the basis of their practical usefulness. The first method uses prefogged silver halide emulsions, and produces direct-positive images after development through destruction of fogged nuclei (latent images) utilizing solarization, Herschel effect or the like. The second method uses nonfogged silver halide emulsions of the internal latent-image type, and produces direct-positive images by surface development after or during fogging processing subsequent to imagewise exposure. The term "silver halide emulsions of the internal latent-image type" as used above refers to silver halide photographic emulsions containing light-sensitive nuclei mainly inside the silver halide grains, that form a latent image mainly inside the grains upon exposure. Such methods of the second type generally provide high sensitivity, compared with those of the first type, and are suitable for uses in which high sensitivity is required. The present invention relates to a method of this type.

Various methods of the second type are known in the art, including the principal processes described, e.g., in U.S. Pat. Nos. 2,592,250, 2,466,957, 2,497,875, 2,588,982, 3,317,322, 3,761,266, 3,761,276 and 3,796,577, British Pat. Nos. 1,151,363 and 1,150,553. By these known methods, direct-positive photographic light-sensitive materials having relatively high sensitivity can be produced.

Details of the mechanism of direct-positive image formation are described, e.g., in T. H. James, *The Theory of the Photographic Process* (4th ed., 1977), Chap. 7, pp. 182–193, and U.S. Pat. No. 3,761,276. Specifically, it is believed that the surface desensitization attributable to internal latent images produced inside silver halide grains by the first imagewise exposure results in selective formation of fogged nuclei only on the individual surfaces of silver halide grains present in unexposed areas, and that conventional surface-development processing produces a photographic direct-positive image in the unexposed areas.

In order to selectively form fogged nuclei, as described above, a second exposure can be applied to the whole surface of a light-sensitive layer, by what is generally called an "optical fogging method" (described, e.g., in British Pat. No. 1,151,363), or a nucleating agent can be used in a "chemical fogging method" (described, e.g., in *Research Disclosure,* Vol. 151, No. 15162, pp. 76–78 (November 1976)).

Formation of direct-positive color images can be achieved by subjecting silver halide photographic materials of the internal latent-image type to surface color development-processing simultaneous with or subsequent to a fogging treatment, followed by bleach processing and then fixation processing, or by bleach-fix processing. After bleaching and fixing the material is washed and/or stabilized.

In a chemical fogging method which has conventionally been employed in the above-described process, compounds capable of acting as nucleating agents only in a high pH range above 12 have been used. Under such high pH conditions, developing agents are subject to deterioration due to air oxidation, and consequently, the chemical fogging method has the defect of being accompanied by a significant decrease in development activity. In addition, a decrease in the rate of development requires increased processing time. Using a developer at a lower pH is particularly undesirable, because it necessitates a still longer processing time. Even in the pH range above 12, development requires a long time for completion.

In contrast, optical fogging methods are relatively advantageous in practical use, since they do not require high pH conditions. However, there are various technical problems in applying such methods to widely varying photographic purposes. Specifically, the optical fogging method is based on the formation of fogged nuclei through photolysis of silver halides, so that correct illuminance and correct exposure depend on the kind of silver halide used and its characteristics. Therefore, it is difficult to achieve consistent results in fogging silver halides. In addition, the method has the disadvantages of requiring a complex and expensive developing apparatus, as well as long development time.

As described above, it is difficult for either conventional fogging method to provide direct-positive images of excellent quality rapidlly and consistently. In order to overcome these problems, the use of compounds exhibiting nucleating capabilities even at a pH below 12 is proposed in Japanese Patent Application (OPI) No. 69613/77 (the term "OPI" as used herein means an "unexamined published Japanese patent application"), and U.S. Pat. Nos. 3,615,615 and 3,850,638. However, those nucleating agents have an adverse effect such that they act on silver halides or are subject to decomposition during storage of photosensitive materials before photographic processing, resulting in lower maximum density of the developed images.

It is disclosed in U.S. Pat. No. 3,227,552 that an increase in development rate can be achieved in the medium density region by using specified hydroquinone derivatives. However, such development rates remain insufficient, particularly when developers adjusted to a pH below 12 are used.

It is also disclosed in Japanese Patent Application (OPI) No. 170843/85 that maximum image density can be increased by the addition of mercapto compounds containing a carboxylic acid group or a sulfonic acid group. However, the effect on increase of maximum image density produced by these compounds is also inadequate.

Further, Japanese Patent Application (OPI) No. 134848/80 indicates that minimum image density can be decreased by carrying out development processing in the presence of a nucleating agent using a processing solution (pH 12.0) containing a tetraazaindene-series compound that prevents rereversal negative-image formation. However, neither maximum image density nor development rate is increased by this method.

In addition, Japanese Patent Publication No. 12709/70 proposes the addition of a triazoline thione-series compound or a tetrazoline thione-series compound as an antifoggant to a photosensitive material capable of forming a direct-positive image using an optical fogging method. However, this method also fails to provide high maximum density or a high development rate.

No method has yet been discovered capable or rapidly forming direct-positive images while furnishing both satisfactory high maximum density and satisfactory low minimum density. Such a method is particularyl desired in instant color photography (a color material diffusion transfer process) which requires image formation in a short time. Here as well, a quicker method of image formation is eagerly sought.

Furthermore, it is generally known such a disadvantage that the higher the sensitivity of direct-positive emulsion is, the more the generation of rereversal of negative image under high intensity exposure is.

SUMMARY OF THE INVENTION

Therefore, an object of the present invention is to provide a method for rapid and consistent direct-positive image formation providing high maximum density and low minimum density, using nonprefogged silver halide photosensitive materials of the internal latent-image type.

Another object of the present invention is to provide a method for forming a direct-positive image, in which rereversal of negative images under high intensity exposure is reduced.

Still another object of the present invention is to provide a method for forming a direct-positive image, in which variations in maximum and minimum image densities from their respective optimal values are slight, and change in color reproduction in color photosensitive materials, is insignificant, even if fluctuations in temperature and pH of developer occur.

A further object of the present invention is to provide a method for forming a direct-positive image, in which even when development varies from the standard developing time, both maximum image density and minium large density remain close to their respective optimal values, and gradation also is scarcely effected.

Another object of the present invention is to provide a method for forming a direct-positive image, which preserves optimal maximum image density and minimum density even when a photosensitive material is employed after a long period of storage.

A further object of the present invention is to provide a method for forming a direct-positive image, in which the deterioration of the developer due to air oxidation is reduced, and the activity of the developer remains constant.

Yet a further object of the present invention is to provide a method for forming a direct-positive color image, in which color reproduction is little affected even when development is carried out for a time deviating from the standard developing time.

It has now been discovered that these and other objects of the present invention are effectively attained by a process for forming a direct-positive image by including the step of developing an image exposed photosensitive material, having a support and at least one photographic emulsion layer thereon containing nonprefogged silver halide grains capable of forming an internal latent image, the development step being carried out in the presence of a combination of a nucleating agent and at least one compound having at least one mercapto group selected from a tetraazaindene, a triazaindene and a pentazaindene, further provided that the hydrogen atom of the mercapto group may be replaced by the alkali metal atom or an ammonium group.

DETAILED DESCRIPTION OF THE INVENTION

The term "nucleating agent" as used herein includes any substance capable of forming direct-positive images when applied to a nonprefogged silver halide emulsion of the internal latent-image type in the course of surface development.

The above-described compound containing at least one mercapto group used in combination with nucleating agents in the present invention acts as a nucleation accelerator. The term "nucleation accelerator" used herein refers to substances that alone have substantially no function as nucleating agents but that increases the action of a nucleating agent to increase the maximum density of direct-positive image and/or shorten the developing time required to attain a prescribed density of the direct-positive image. Nucleation accelerators can be used alone or in a combination of two or more thereof.

Turning first to the compound containing at least one mercapto group, the nucleation accelerators used in the present invention is now described in greater detail.

Suitable examples of triazaindene compounds, tetraazaindene compounds or pentaazaindene compounds which can be used in the present invention include 5H-pyrrolo[3,2-d]pyrimidines, 1H-imidazo[4,5-b]pyridines, 1H-pyrrolo[2,3-d]pyridazines, s-triazolo[4,3-a]pyridines, s-triazolo[1,5-a]pyrimidines, 1H-imidazo[4,5-d]pyrimidines, s-triazolo[4,3-a]pyrimidines, s-triazolo[4,3-c]pyrimidines, s-triazolo[4,3-b]pyridazines, 1H-pyrazolo[3,4-d]pyrimidines, v-triazolo[4,5-d]pyrimidines, tetraazolo[1,5-a]pyrimidines, and the like.

At least one mercapto group is directly bonded on the heterocyclic ring in each of the above-described heterocyclic compounds, and may be either —SH or a substituted mercapto group formed by replacing the hydrogen of —SH with an alkali metal atom (e.g., sodium atom, potassium atom and the like), or an ammonium group (e.g., trimethylammonium group, dimethylbenzylammonium group and the like).

The above-described heterocyclic ring compound nucleation accelerators may contain only the required mercapto or substituted mercapto substituent, or may be further substituted.

Suitable examples of groups with which the foregoing heterocyclic rings may further be substituted include nitro groups, halogen atoms (e.g., chlorine atoms, bromine atoms, etc.), cyano groups, substituted or unsubstituted alkyl groups (e.g., methyl, ethyl, propyl, t-butyl, methoxyethyl, methylthioethyl, dimethylaminoethyl, morpholinoethyl, dimethylaminoethylthioethyl, diethylaminoethyl, dimethylaminopropyl, dipropylaminoethyl, dimethylaminohexyl, methylthiomethyl, methoxyethoxyethoxyethyl, trimethylaminoethyl, cyanoethyl and the like groups), substituted or unsubstituted aryl groups (e.g., phenyl, 4-methanesulfonamidophenyl, 4-methylphenyl, 3-methoxyphenyl, 4-dimethylaminophenyl, 3,4-dichlorophenyl, naphthyl and the like groups), substituted or unsubstituted alkenyl groups (e.g., allyl and the like groups), substituted or unsubstituted aralkyl groups (e.g., benzyl, 4-methylbenzyl, phenetyl, 4-methoxybenzyl and the like groups), substituted or unsubstituted alkoxy groups (e.g., methoxy, ethoxy, methoxyethoxy, methylthioethoxy, dimethylaminoethoxy and the like groups), substituted or unsubstituted aryloxy groups (e.g., phenoxy, 4-methoxyphenoxy and the like groups), substituted or unsubstituted alkylthio groups (e.g., methylthio, ethylthio, propylthio, methylthioethyl, dimethylaminoethylthio, methoxyethylthio, morpholinoethylthio, dimethylaminopropylthio, piperidinoethylthio, pyrrolidinoethylthio, morpholinoethylthioethylthio, imidazolylethylthio, 2-pyridylmethylthio, diethylaminoethylthio and the like groups), substituted or unsubstituted arylthio groups (e.g., phenylthio, 4-dimethylaminophenylthio and the like groups), substituted or unsubstituted heterocyclic oxy groups (e.g., 2-pyridyloxy, 2-imidazolyloxy and the like groups), substituted or unsubstituted heterocyclic thio groups (e.g., 2-benzothiazolylthio, 4-pyrazolylthio and the like groups), substituted or unsubstituted sulfonyl groups (e.g., methanesulfonyl, ethanesulfonyl, p-toluenesulfonyl, methoxyethylsulfonyl, dimethylaminoethylsulfonyl and the like groups), substituted or unsubstituted carbamoyl groups (e.g., carbamoyl, methylcarbamoyl, dimethylaminoethylcarbamoyl, methoxyethylcarbamoyl, morpholinoethylcarbamoyl, methylthioethylcarbamoyl, phenylcarbamoyl and the like groups), substituted or unsubstituted sulfamoyl groups (e.g., sulfamoyl, methylsulfamoyl, imidazolylethylsulfamoyl, phenylsulfamoyl and the like groups), substituted or unsubstituted carbonamido groups (e.g., acetamido, benzamido, methoxypropionamido, dimethylaminopropionamido and the like groups), substituted or unsubstituted sulfonamido groups (e.g., methanesulfonamido, benzenesulfonamido, p-toluenesulfonamido and the like groups), substituted or unsubstituted acyloxy groups (e.g., acetyloxy, benzoyloxy and the like groups), substituted or unsubstituted sulfonyloxy groups (e.g., methanesulfonyloxy and the like groups), substituted or unsubstituted ureido groups (e.g., ureido, methylureido, ethylureido, methoxyethylureido, dimethylaminopropylureido, methylthioethylureido, morpholinoethylureido, phenylureido and the like groups), substituted or unsubstituted thioureido group (e.g., thioureido, methylthioureido, methoxyethylthioureido and the like groups), substituted or unsubstituted acyl groups (e.g., acetyl, benzoyl, 4-methoxybenzolyl and the like groups), substituted or unsubstituted heterocyclic groups (e.g., 1-morpholino, 1-piperidino, 2-pyridyl, 4-pyridyl, 2-thienyl, 1-pyrazolyl, 1-imidazolyl, 2-tetrahydrofuryl, tetrahydrothienyl and the like groups), substituted or unsubstituted oxycarbonyl groups (e.g., methoxycarbonyl, phenoxycarbonyl, methoxyethoxycarbonyl, methylthioethoxycarbonyl, methoxyethoxyethoxyethoxycarbonyl, dimethylaminoethoxycarbonyl, morpholinoethoxycarbonyl and the like groups), substituted or unsubstituted oxycarbonylamino groups (e.g., methoxycarbonylamino, phenoxycarbonylamino, 2-ethylhexyloxycarbonylamino and the like groups), substituted or unsubstituted amino groups (e.g., amino, dimethylamino, methoxyethylamino, anilino and the like groups), carboxylic acid groups or the salts thereof, sulfonic acid groups or the salts thereof, hydroxyl groups and the like. However, it is preferred to obtain greater nucleation accelerating effects that the foregoing hetero rings not be substituted with carboxylic acid groups or the salts thereof, sulfonic acid groups or the salt thereof, or hydroxyl groups. Preferred examples of the groups include unsubstituted alkyl groups having 1 to 6 carbon atoms, unsubstituted alkylthio groups having 1 to 6 carbon atoms and unsubstituted acyl groups having 1 to 6 carbon atoms. More preferred examples of the groups include unsubstituted alkyl groups having 1 to 4 carbon atoms.

Of the foregoing hetero ring-containing nucleation accelerators, s-triazolo[4,3-a]pyrimidines, s-triazolo[1,5-a]pyrimidines, s-triazolo[4,3-c]pyrimidines and s-triazolo[4,3-b]pyridazines are more preferably used in the present invention.

The nucleation accelerator to be used in the present invention can be synthesized with ease by reference to the methods described in *The Journal of Organic Chemistry*, Vol. 24, pp. 779–801 (1959), ibid., Vol. 25, pp. 861–866 (1960), U.S. Pat. Nos. 2,152,460, 2,713,541, 2,743,181, 2,743,180, 2,887,378, 2,935,404, 2,444,609, 2,933,388, 2,891,862, 2,861,076, 2,735,769 and so on.

Specific examples of nucleation accelerators used in the present invention are illustrated below. However, the present invention is not to be construed as being limited to these compounds.

1.

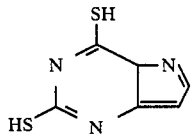

2.

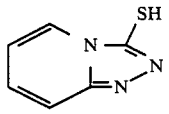

3.

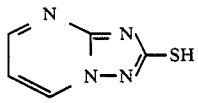

4.

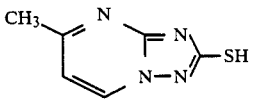

5.

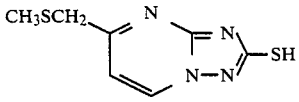

6.

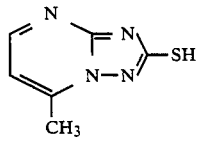

7.

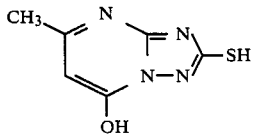

-continued
8.
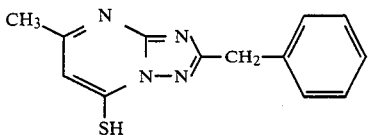
9.
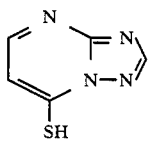
10.
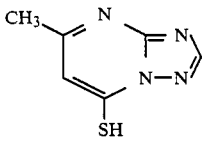
11.
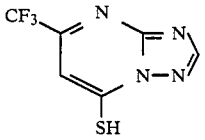
12.
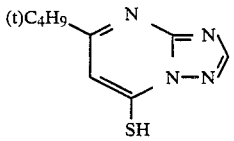
13.
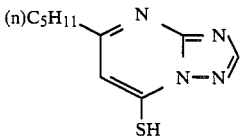
14.
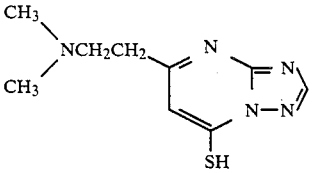
15.
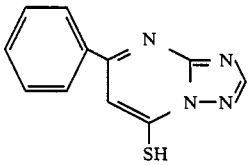
16.
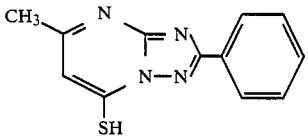
17.
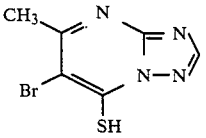
-continued
18.
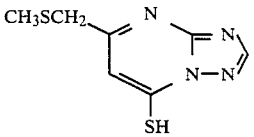
19.
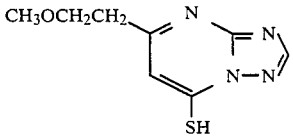
20.
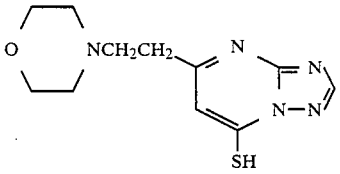
21.
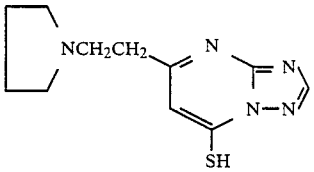
22.
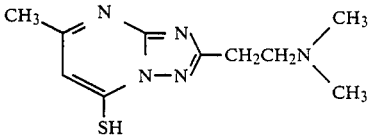
23.
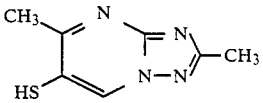
24.
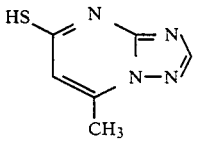
25.
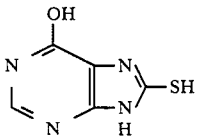
26.
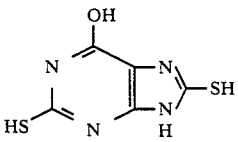
27.
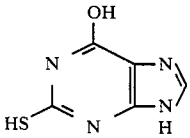

-continued
28.
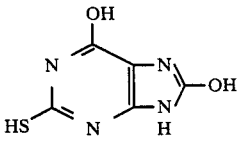
29.
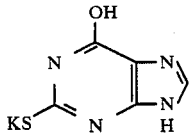
30.
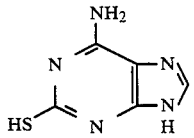
31.
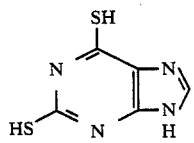
32.
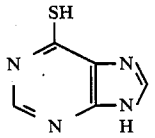
33.
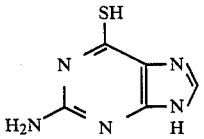
34.
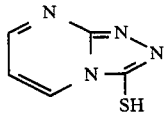
35.
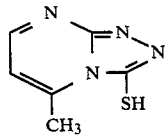
36.
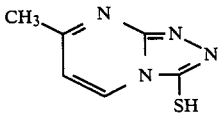
37.
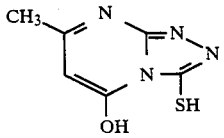
38.
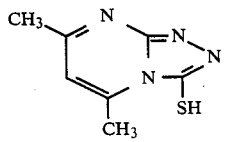
-continued
39.
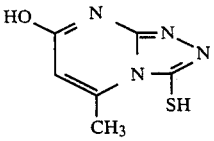
40.
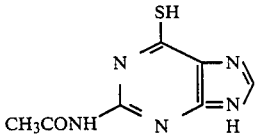
41.
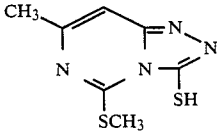
42.
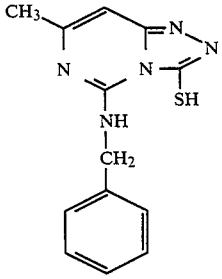
43.
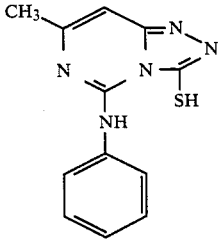
44.
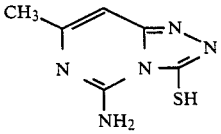
45.
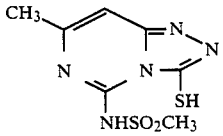
46.
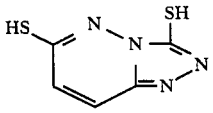
47.
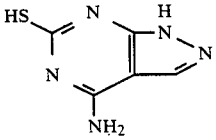

-continued

48.

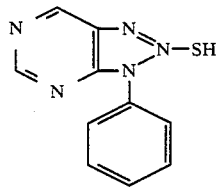

49.

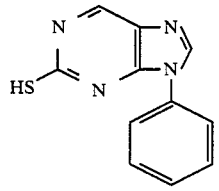

50.

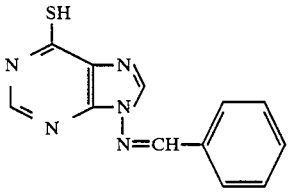

51.

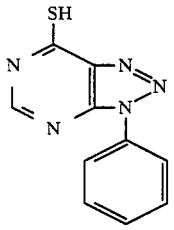

Preferred examples of the nucleation accelerators used in the present invention include compounds represented by each of the general formulae (I) to (IV):

(I)

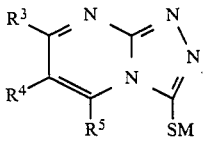

(II)

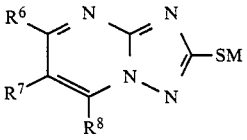

(III)

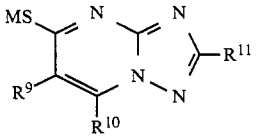

(IV)

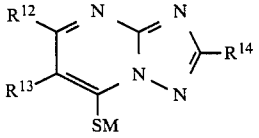

wherein M represents a hydrogen atom, an alkali metal (such as sodium, potassium and lithium), an ammonium group (such as a trimethylammonium group, a dimethylbenzylammonium group, etc.), and $R^3$, $R^4$, $R^5$, $R^6$, $R^7$, $R^8$, $R^9$, $R^{10}$, $R^{11}$, $R^{12}$, $R^{13}$ and $R^{14}$ each represents a hydrogen atom or a substituent group, and they each preferably represents a hydrogen atom, an alkyl group having 1 to 6 carbon atoms, an alkylthio group having 1 to 6 carbon atoms and a cyano group having 1 to 6 carbon atoms.

The nucleation accelerator illustrated above can be present either in the photosensitive material or a processing solution. Incorporation in a photosensitive material, particularly in an internal latent-image type silver halide emulsion layer or another hydrophilic colloid layer (e.g., an interlayer, a protective layer, or so on), is preferred. Of these layers, a silver halide emulsion layer or a layer adjacent thereto is particularly preferred.

The amount of nucleation accelerator incorporated in a photosensitive material ranges preferably from about $10^{-6}$ to $10^{-2}$ mole, particularly from about $10^{-5}$ to $10^{-2}$ mole, per mole of total silver halide in the material.

A processing solution, i.e., a developing solution or a prebath thereof, contains the nucleation accelerator in an amount of preferably about $10^{-8}$ to $10^{-3}$ mole, particularly about $10^{-7}$ to $10^{-4}$ mole, per liter thereof.

The nucleation accelerator exhibits almost the similar effect, regardless of whether it is incorporated in the developing solution or in the prebath thereof. Generally, the developing solution is alkaline and the prebath is neutral. Therefore, it is preferred that the nucleation accelerator which is apt to be decomposed under alkaline condition is incorporated into the prebath.

Two or more of the nucleation accelerators may be used in combination.

The expression "nonprefogged silver halide emulsion of the internal latent-image type" and similar language used herein signifies an emulsion containing silver halide grains that are not fogged chemically or by light in manufacture at their respective surfaces, and that form a latent image mainly in the interior thereof. More specifically, this emulsion is defined as one which, when coated on a transparent support at a definite coverage, exposed to light for a fixed period of time ranging from 0.01 to 10 sec., and then developed with the following developer A (internal developer) for 5 min. at 18° C., produces maximum image density, as determined by conventional photographic density measurement, that is at least about 5 times, and preferably at least about 10 times, the maximum image density obtained by coating the emulsion at the same coverage, carrying out exposure in the same manner, and developing the material with the following developer B (surface developer) for 6 min. at 20° C.:

| | |
|---|---|
| Internal Developer A | |
| Metol | 2 g |
| Sodium Sulfite (anhydrous) | 90 g |
| Hydroquinone | 8 g |
| Sodium Carbonate (monohydrate) | 52.5 g |
| KBr | 5 g |
| KI | 0.5 g |
| Water to make | 1 liter |
| Surface Developer B | |
| Metol | 2.5 g |
| l-Ascorbic Acid | 10 g |
| $NaBO_2 \cdot 4H_2O$ | 35 g |
| KBr | 1 g |
| Water to make | 1 liter |

Suitable examples of internal latent-image type emulsions include conversion type silver halide emulsions and core/shell type silver halide emulsions, as described in British Pat. No. 1,011,062, U.S. Pat. Nos. 2,592,250 and 2,456,943. Specific examples of core/shell type silver halide emulsions include those described in Japanese patent application (OPI) Nos. 32813/72, 32814/72, 134721/77, 156614/77, 60222/78, 66218/78, 66727/78, 127549/80, 136641/82, 70221/83, 208540/84, 216136/84 107641/85, 247237/85, 2148/86 and 3137/86, Japanese patent publication Nos. 18939/81, 1412/83, 1415/83, 6935/83 and 108528/83, Japanese patent application No. 36424/86, U.S. Pat. Nos. 206,313, 3,317,322, 3,761,266, 3,761,276, 3,850,637, 3,923,513, 4,035,185, 4,395,478 and 4,504,570, European Pat. No. 0017148 and *Research Disclosure,* RD-16345 (Nov. 1977).

Silver halide compositions useful in the internal latent image emulsions of the present invention include silver chloride, silver bromide, and mixed silver halides such as silver chlorobromide, silver chloroiodobromide, silver iodobromide, and the like. Silver halides which are preferably used in the present invention include silver chloro(iodo)bromide, silver (iodo)chloride and silver (iodo)bromide, in each which the iodide content is about 3 mole% or less.

The mean grain size of the silver halide grains employed in the present invention ranges preferably from about 0.1 micron to 2 microns, particularly preferably from about 0.15 micron to 1 micron The term "grain size" as used herein refers to grain diameter in the case of grains spherical or approximately spherical in shape, and refers to edge length in the case of cubic grains. In both cases, it is determined as the mean value based on the projected areas of the grains. The distribution of the grain size may be either narrow or broad. However, it is preferred to use a monodisperse silver halide emulsion, which has a narrow grain size distribution such that about 90% or more, particularly about 95% or more, of the grains have sizes falling with a range of the number or weight average grain diameter, about ±40%, more preferably about ±30%, and most preferably about ±20%, in order to improve graininess, sharpness and so on. In order to provide suitable gradation in the photosensitive material, monodisperse silver halide emulsions having substantially the same color sensitivity but differing in grain size, or those having the same grain size but different sensitivities can be coated in a single layer as a mixture, or they can be coated separately in multiple layers. Also, two or more polydisperse silver halide emulsions, or a combination of monodisperse and polydisperse emulsions may be coated as a mixture, or separately in multiple layers.

The silver halide grains employed in the present invention may have a regular crystal form, such as a cube, an octahedron, a dodecahedron or a tetradecahedron, or an irregular crystal form, such as a sphere and so on. The grains may have a composite form of these crystal forms, or a tabular form in which grain diameter is greater than grain thickness by a factor of about 5 or more, particularly about 8 or more. Emulsions which contain such tabular grains in an amount of about 50% or more based on the total projected area of all grains present may be employed in this invention. Emulsions containing silver halide grains having various crystal forms as a mixture also may be employed.

The silver halide emulsions employed in the present invention can be chemically sensitized in the interior of the grains or at their surfaces, using a sulfur or selenium sensitization method, a reduction sensitization method, a noble metal sensitization method or any other conventional method, either alone or in combination.

Photographic emulsions employed in accordance with the present invention can be spectrally sensitized with photographic sensitizing dyes in a conventional manner. Particularly useful dyes include cyanine dyes, merocyanine dyes, and complex meerocyanine dyes. These dyes can be used alone or in combination. In addition, the foregoing dyes may be used in combination with supersensitizing agents. Specific examples and uses of such spectral sensitizing dyes are described in detail, e.g., in *Research Disclosure,* RD-17643, IV (Dec. 1978).

The photographic emulsion used in the present invention can contain benzenethiosulfonic acids, benzenesulfinic acids, thiocarbonyl compounds and other conventional compounds used for the purposes of preventing fog or stabilizing photographic properties during production, storage, or photographic processing. More specific examples of antifoggants and stabilizers and uses thereof are described, e.g., in U.S. Pat. Nos. 3,954,474 and 3,982,947, Japanese patent publication No. 28660/77, *Research Disclosure,* RD-17643, VIA-VIM (Dec. 1978), and E. J. Birr, *Stabilization of Photographic Silver Halide Emulsions,* pp. 52–99 (Focal Press, 1974). The photographic emulsion used in the present invention can contain a single photographic emulsion or a mixture of two or more photographic emulsions differing in grain size or sensitivity. Also, two or more photographic emulsions which are same in color sensitivity but differ in grain size or sinsitivity may be coated separately in a multilayer.

The nucleating agent used in the present invention can incorporated either in the photosensitive material or a processing solution. However, it is preferred to incorporate the nucleating agent into a photosensitive material. In this case, the nucleating agent is preferably added to an internal latent-image type silver halide emulsion layer, although it may be added to another layer, such as an interlayer, a subbing layer or a backing layer, provided that it can diffuse into the silver halide emulsion layer during coating or processing to adsorb to silver halide grains. When it is added to a processing solution, on the other hand, the nucleating agent may be added to a developer, or a prebath with a low pH value, as described in Japanese patent application (OPI) No. 178350/83.

When incorporated into a photosensitive material, the nucleating agent is used in an amount of about $10^{-8}$ to $10^{-2}$ mole, preferably about $10^{-7}$ to $10^{-3}$ mole, per mole of total silver halide in the photographic material.

When added to a processing solution, the nucleating agent is used in an amount of about $10^{-5}$ to $10^{-1}$ mole, preferably about $10^{-4}$ to $10^{-2}$ mole, per liter.

Nucleating agents which can be employed in the present invention include all conventionally known compounds which cause nucleation in silver halide grains without particular limitation. The nucleating agents may be used alone or in a combination of two or more thereof. Specific examples of such compounds include those described in *Research Disclosure,* RD-22534, pp. 50–54 (Jan. 1983). They may be classified generally into three groups, i.e., hydrazine-series compounds, quaternary heterocyclic compounds, and compounds that are neither hydrazines or quaternary heterocyclic compounds.

Hydrazine-series compounds include those described in *Research Disclosures* No. 15162, pp. 76–77 (Nov. 1976), and No. 23510, pp. 346–352 (November, 1983). Hydrazine-series nucleating agents having a silver halide-adsorbing group are described, e.g., in U.S. Pat. Nos. 4,030,925, 4,080,207, 4,031,127, 3,718,470, 4,269,929, 4,276,364, 4,278,748, 4,385,108 and 4,459,347, British Pat. No. 2,011,391 B, and Japanese patent application (OPI) Nos. 74729/79, 163533/80, 74536/80 and 179734/85.

Other hydrazine-series nucleating agents are described, e.g., in Japanese patent application (OPI) No. 86829/82, and U.S. Pat. Nos. 4,560,638, 4,478,928, 2,563,785 and 2,588,982.

Examples of quaternary heterocyclic compounds include those described, e.g., in *Research Disclosure,* No. 22534 (Jan. 1983), Japanese patent publication Nos. 38164/74, 19452/77 and 47326/77, Japanese patent application (OPI) Nos. 69613/77, 3426/77, 138742/80 and 11837/85, U.S. Pat. No. 4,306,016, and *Research Disclosure,* No. 23213, pp. 267–270 (Aug. 1983).

Preferred nucleating agents in the present invention are compounds represented by the following general formula (N-I), or the general formula (N-II) set forth and described in greater detail below.

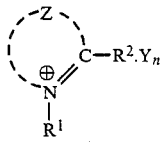

(N-I)

In formula (N-I), Z represents a nonmetallic atomic group necessary to complete an unsubstituted or substituted, 5- or 6-membered hetero ring; $R^1$ represents an unsubstituted or substituted aliphatic group; and $R^2$ represents a hydrogen atom, or an unsubstituted or substituted aliphatic or aromatic group; provided that at least one group selected from those represented by $R^1$, $R^2$ and Z may be substituted with an alkynyl group, an acyl group, a hydrazino group or a hydrazono group; and $R^1$ and $R^2$ may combine with each other to form a 6-membered ring, or a dihydropyridinium skeleton. Further, one or more of $R^1$, $R^2$ and Z can be substituted with substituent group containing a moiety of the formula, $X^1(L^1)_{m1}$, wherein X represents a group capable of accelerating the adsorption of the compound represented by general formula (N-I) to silver halide, $L^1$ represents a divalent linkage group, and $m^1$ represents 0 or 1. In general formula (N-I), Y represents a counter ion required to maintain the balance of electric charge, and n represents 0 or 1.

More specifically, examples of a hetero ring formed by Z include a quinolinium nucleus, a benzothiazolium nucleus, a benzimidazolium nucleus, a pyridinium nucleus, a thiazolinium nucleus, a thiazolium nucleus, a naphthothiazolium nucleus, a selenazolium nucleus, a benzoselenazolium nucleus, an imidazolium nucleus, a tetrazolium nucleus, an indolenium nucleus, a pyrrolinium nucleus, an acridinium nucleus, a phenanthridinium nucleus, an isoquinolinium nucleus, an oxazolium nucleus, a naphthoxazolium nucleus and a benzoxazolium nucleus. Examples of substituent groups for Z include an alkyl group, an alkenyl group, an aralkyl group, an aryl group, an alkynyl group, a hydroxy group, an alkoxy group, an aryloxy groups, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic acid ester group, a hydrazino group, a hydrazono group, an imino group and the like. Z can have one or more substituent groups selected from those groups; and when Z has two or more substituent groups, they may be the same or different. The substituent groups set forth above may further be substituted with one or more of those groups.

Furthermore, Z may be substituted with a heterocyclic quaternary ammonium group formed by Z via an appropriate linkage group L. That is, the compounds represented by the general formula (N-I) may form the bis-compound represented by the following structure:

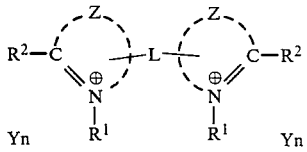

wherein Z, $R^1$, $R^2$, Y and n each has the same significance as in the general formula (N-I) and L represents a divalent linkage group containing at least one of a carbon atom, a nitrogen atom, an oxygen atom and a sulfur atom.

Of the heterocyclic rings formed by Z, quinolinium, benzothiazolium, benzimidazolium, pyridinium, acridinium, phenanthridinium, naphthopyridinium and isoquinolium nuclei are preferred, and quinolinium, benzothiazolium, naphthopyridinium and benzimidazolium nuclei are more preferred. Particularly preferred nuclei are quinolinium, benzothiazolium and naphthopyridinium nuclei, and most preferred is a quinolinium nucleus.

The aliphatic group represented by $R^1$ and $R^2$ is an unsubstituted alkyl group containing 1 to 18 carbon atoms, or a substituted alkyl group whose alkyl moiety contains 1 to 18 carbon atoms. The substituent groups for these alkyl groups include the same substituents as those for Z.

The aromatic group represented by $R^2$ contains 6 to 20 carbon atoms, and specific examples include a phenyl group, a naphthyl group and the like. The aromatic group can be substituted with the same substituents as named above for Z.

At least one group represented by $R^1$, $R^2$ and Z contains an alkynyl group, an acyl group, a hydrazino group or a hydrazono group, and $R^1$ and $R^2$ may combine with each other to form a 6-membered ring or a dihydropyridinium skeleton. In this case, these groups present in $R^1$, $R^2$ and Z and the ring formed by combination of $R^1$ and $R^2$ may further be substituted with one or more of the substituent groups for the ring formed by Z.

Preferred acyl groups include formyl groups and aliphatic or aromatic keto groups.

Preferred hydrazino groups are further substituted, especially by an acyl group or a sulfonyl group.

Preferred hydrazono groups contain an aliphatic or aromatic groups as a substituent group.

Preferred alkynyl substituents for $R^1$, $R^2$ or Z have 2 to 18 carbon atoms, and specific examples include an ethynyl group, a propargyl group, a 2-butynyl group, a 1-methylpropargyl group, a 1,1-dimethylpropargyl group, a 3-butynyl group, a 4-pentynyl group and the like.

These alkynyl groups may further be substituted with those named as substituent groups for Z, and specific examples include a 3-phenylpropargyl group, a 3-methoxycarbonylpropargyl group, 4-methoxy-2-butynyl group, and the like.

When at least one of the substituent groups for $R^1$, $R^2$ and Z is an alkynyl group or an acyl group, it is preferred that $R^1$ and $R^2$ combined with each other to form a dihydroxypyridinium skeleton. Moreover, it is preferred for at least one of the groups or the rings represented by $R^1$, $R^2$ and Z to be substituted by at least one alkynyl group.

Preferred examples of adsorption accelerating groups represented by $X^1$ include thioamido groups, mercapto groups, and 5- or 6-membered nitrogen-contained heterocyclic groups.

Thioamido adsorption-accelerating groups represented by $X^1$ are divalent groups represented by

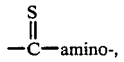

which may be a part of a ring structure or an acyclic thioamido group. Thioamido adsorption-accelerating groups which are useful as $X^1$ include those described, e.g., in U.S. Pat. Nos. 4,030,925, 4,031,127, 4,080,207, 4,245,037, 4,255,511, 4,266,013 and 4,276,364, and *Research Disclosures,* Vol 151, No. 15162 (Nov. 1976) and Vol. 176, No. 17626 (Dec. 1978).

Specific examples of useful acyclic thioamido groups include a thioureido group, a thiourethane group, and a dithiocarbamate group, and examples of cyclic thioamido groups include residues of 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione. These groups each may further be substituted.

The mercapto group represented by $X^1$ includes an —SH group attached directly to the group represented by $R^1$, $R^2$ or Z, and an —SH group bonded to a substituent group attached to the group represented by $R^1$, $R^2$ or Z. The mercapto group includes aliphatic mercapto groups, aromatic mercapto groups and heterocyclic mercapto groups, which are their cyclic thioamido tautomers when the neighboring atom of the carbon atom to which the —SH group is attached is a nitrogen atom because their

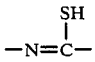

residues and their

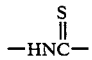

residues are in tautomeric relation. Specific examples include those named above as cyclic thioamido group.

Examples of the 5- or 6-membered nitrogen-contained heterocyclic group represented by $X^1$ include those containing any of nitrogen, oxygen, sulfur and carbon atoms, alone or in combination. Preferred examples of such heterocyclic groups include benzotriazolyl, triazolyl, tetrazolyl, indazolyl, benzimidazolyl, imidazolyl, benzothiazolyl, thiazolyl, benzoxazolyl, oxazolyl, thiadiazolyl, oxadiazolyl and triazinyl groups. These groups may further be substituted with a substituent group named for Z. More preferred examples of nitrogen-contained heterocyclic rings include benzotriazole, triazole, tetrazole and indazole rings, and most preferred of these rings is benzotriazole.

The divalent linkage group represented by $L^1$ is an atom or a group containing at least one atom selected from among C, N, S and O. Specific examples of such a linkage group include an alkylene group, an alkenylene group, an alkynylene group, an arylene group, and —NH—, each of which may have a substituent group; —N=, —O—, —S—, —CO—, —$SO_2$—; and a combination of two or more thereof.

The counter ion required to maintain the balance of electric charge represented by Y is an arbitrary anion used to balance the positive charge present in the quaternary nitrogen of a heterocyclic nucleus. Specific examples include a bromide ion, a chloride ion, an iodide ion, a p-toluenesulfonic acid ion, an ethylsulfonic acid ion, a perchloric acid ion, a trifluoromethanesulfonic acid ion, and a thiocyanate ion. In these cases, n is 1. If a heterocyclic quaternary ammonium salt contains an anion such as a sulfoalkyl substituent, it can form a betaine, and requires no counter ion, that is, n is 0. In another case, in which a heterocyclic quaternary ammonium salt contains two anionic substituents, e.g., two sulfoalkyl groups, Y represents a cationic counter ion, with specific examples including alkali metal ions (such as a sodium ion, a potassium ion, etc.) and ammonium salts (such as triethylammonium, etc.).

Specific examples of the compounds represented by general formula (N-I) are illustrated below. However, the present invention is not to be construed as being limited to these examples.

(1)

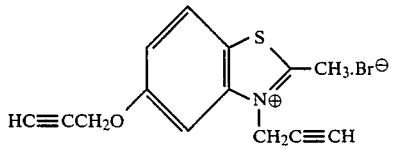

-continued
(2)
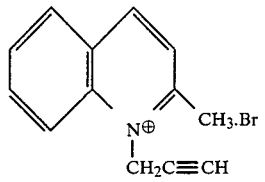
(3)
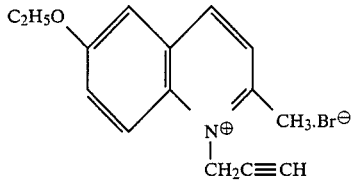
(4)
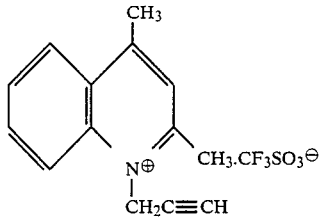
(5)
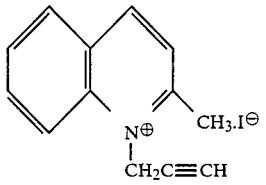
(6)
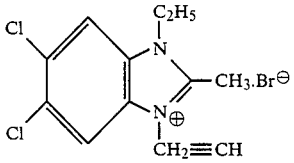
(7)
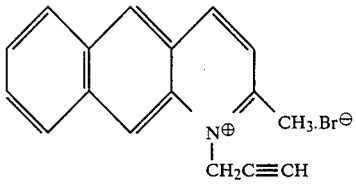
(8)
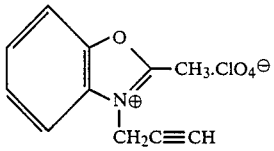
(9)
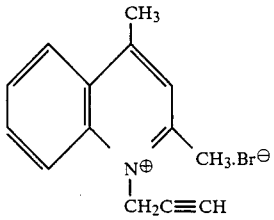

-continued
(10)
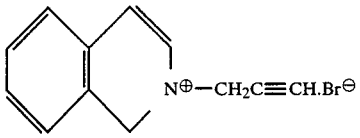
(11)
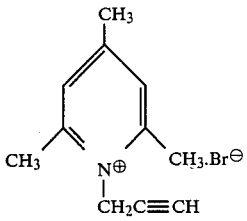
(12)
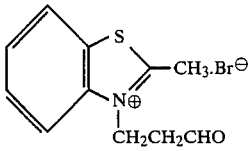
(13)
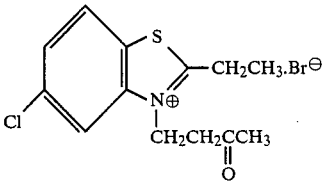
(14)
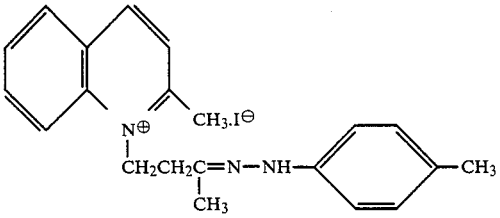
(15)
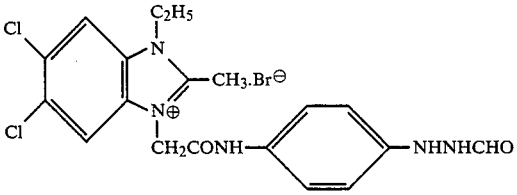
(16)
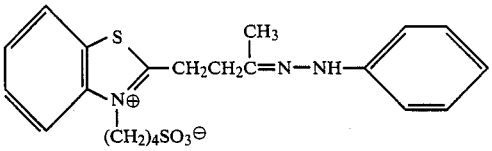
(17)
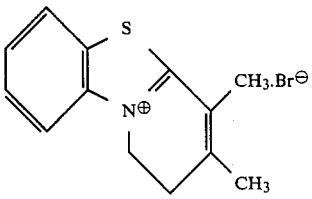

-continued
(18)
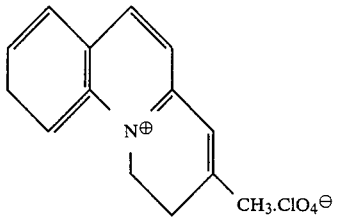
(19)
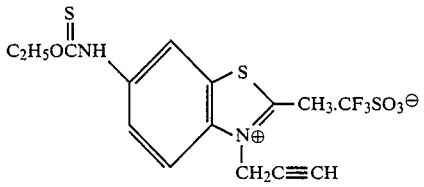
(20)
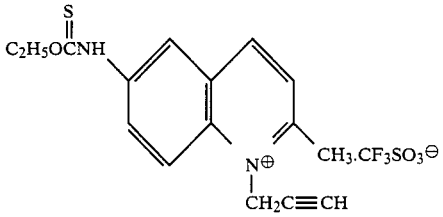
(21)
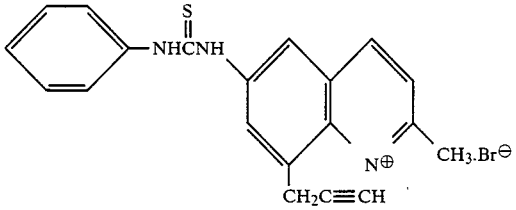
(22)
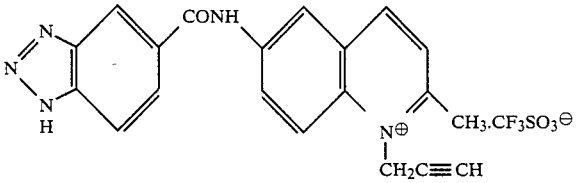
(23)
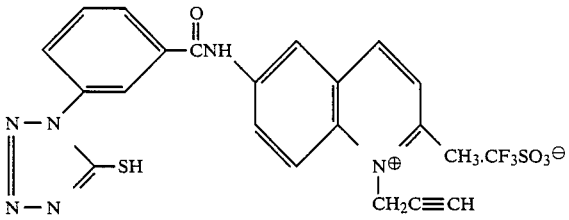
(24)
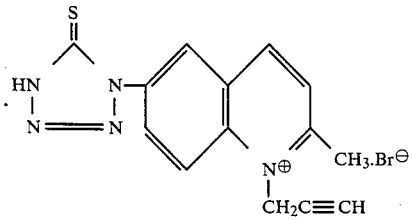

-continued
(25)
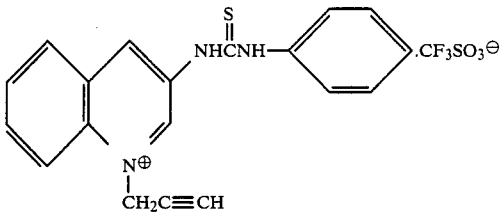
(26)
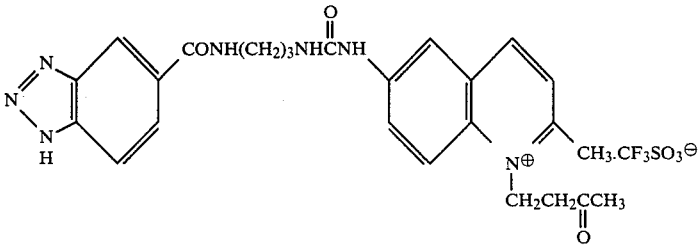
(27)
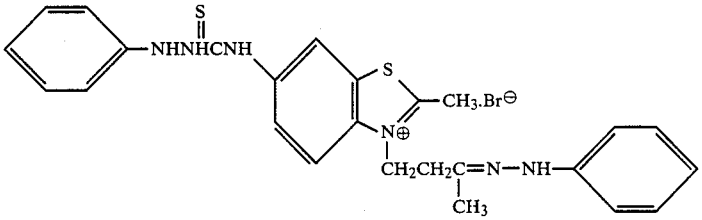
(28)
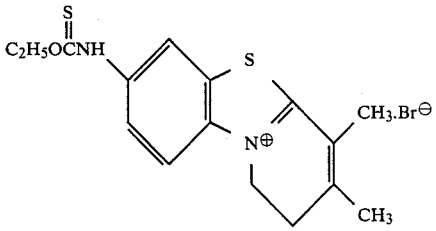
(29)
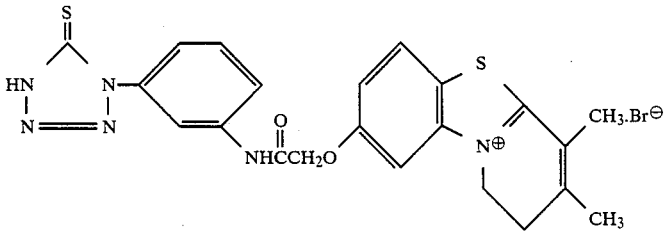
(30)
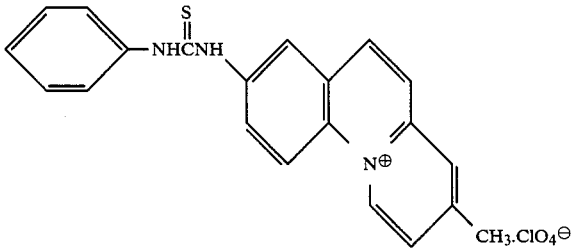
(31)
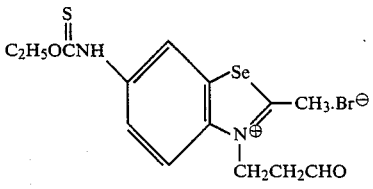

-continued (32)

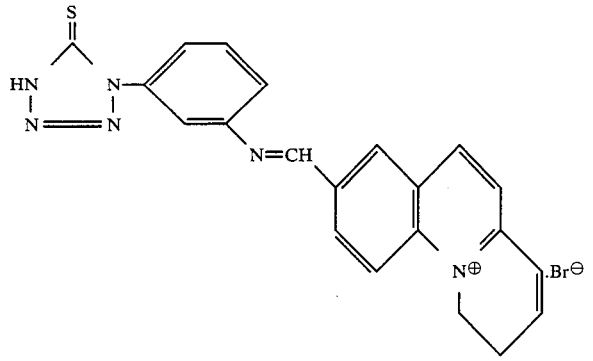

(33)

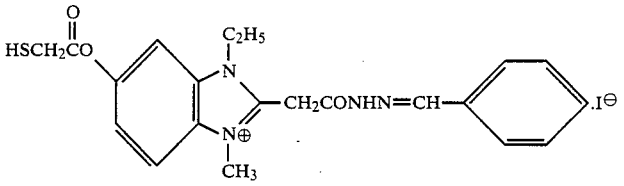

(34)

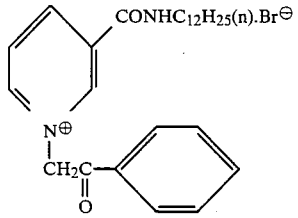

(35)

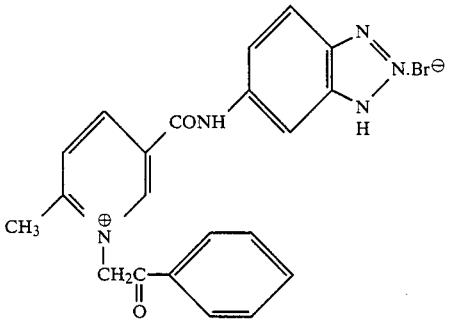

The compounds illustrated above can be synthesized using methods described, e.g., in the patents referred to in *Research Disclosure,* No. 22534, pp. 50–54 (Jan. 1983), and U.S. Pat. No. 4,471,044, or analogous methods.

Another preferred nucleating agent in the present invention is represented by the following general formula (N-II):

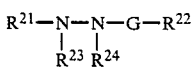

(N-II)

In the formula (N-II), $R^{21}$ represents an aliphatic group, an aromatic group, or a heterocyclic group; $R^{22}$ represents a hydrogen atom, an alkyl group, an aralkyl group, an aryl group, an alkoxy group, an aryloxy group, or an amino group; G represents a carbonyl group, a sulfonyl group, a sulfoxy group, a phosphoryl group, or an iminomethylene group,

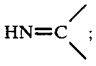

$R^{23}$ and $R^{24}$ each represents a hydrogen atom, or one of them represents a hydrogen atom and the other represents an alkylsulfonyl group, an arylsulfonyl group or an acyl group. In addition, the above-described groups may each be substituted if substitution is possible.

In the general formula (N-II), the aliphatic group represented by $R^{21}$ is a straight chain, branched chain or cyclic alkyl, alkenyl, or alkynyl group. The aromatic group represented by $R^{21}$ is a monocyclic or bicyclic aryl group, specific examples of which include a phenyl group and a naphthyl group. The heterocyclic group represented by $R^{21}$ is a 3- to 10-membered saturated or unsaturated heterocyclic group containing at least one hetero atom selected from N, O and S, which may be a single ring, or may be fused together with another aromatic or heterocyclic ring. Among these, preferred heterocyclic rings are 5- or 6-membered aromatic heterocyclic groups, including a pyridyl group, quinolinyl group, an imidazolyl group, a benzimidazolyl group, and so on.

Each of the above groups represented by $R^{21}$ may have a substituent group. Examples of suitable substituent groups, which may be further substituted, include an alkyl group, an aralkyl group, an alkoxy group, an alkyl or aryl group-substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group and a carboxyl group. If possible, these groups may combine with each other to form a ring.

Preferred $R^{21}$ groups include an aromatic group, an aromatic heterocyclic group, and a methyl group substituted with an aryl group, and an aryl group is more preferred.

Preferred $R^{22}$ groups when G represents a carbonyl group include a hydrogen atom, an alkyl group (e.g., a methyl group, a trifluoromethyl group, a 3-hydroxypropyl group, and a 3-methanesulfonamidopropyl group), an aralkyl group (e.g., an o-hydroxybenzyl group), an aryl group (e.g., a phenyl group, a 3,5-dichlorophenyl group, an o-methanesulfonamidophenyl group, and a 4-methanesulfonylphenyl group). In particular, a hydrogen atom is more preferred.

When G represents a sulfonyl group, preferred $R^{22}$ groups include an alkyl group (e.g., a methyl group), an aralkyl group (e.g., an o-hydroxyphenylmethyl), an aryl group (e.g., a phenyl group), and a substituted amino group (e.g., a dimethylamino group).

Examples of substituents for represented by $R^{22}$ include not only those cited as substituent groups for $R^{21}$, but in addition an acyl group, an acyloxy group, an alkyl- or aryl-oxycarbonyl group, an alkenyl group, an alkynyl group, and a nitro group.

These substituent groups may further be substituted with some of these substituents. In addition, if possible $R^{21}$ and $R^{22}$ may combine with each other to form a ring.

It is preferred that $R^{21}$ or $R^{22}$, and especially $R^{21}$, contain a nondiffusible group or a ballast group which has been used in conventional couplers. Specifically, such a ballast group contains 8 or more carbon atoms, including an alkyl group, a phenyl group, an ether group, an amido group, a ureido group, a urethane group, a sulfonamido group, a thioether group, or combinations of two or more of these groups.

$R^{21}$ or $R^{22}$ may contain a group capable of promoting the adsorption of the compound represented by the general formula (N-II) onto the surface of a silver halide grains, that is, a group represented by $X^2(L^2)_{m2}$, where $X^2$ has the same meaning as $X^1$ in the general formula (N-I) as defined above, and preferably represents a thioamido group (with the exception of an unsubstituted or substituted thiosemicarbazido group), a mercapto group, a ureido group, or a 5- or 6-membered nitrogen-contained heterocyclic group, $L^2$ represents a divalent linkage group, and has the same meaning as $L^1$ in the general formula (N-I), and $m^2$ is 0 or 1.

More preferred $X^2$ groups include a cyclic thioamido group (e.g., a mercapto-substituted, nitrogen-containing heterocyclic group, such as a 2-mercaptothiadiazolyl group, a 3-mercapto-1,2,4-triazolyl group, a 5-mercaptotetrazolyl group, a 2-mercapto-1,3,4-oxadiazolyl group, or a 2-mercaptobenzoxazolyl group), and a nitrogen-containing heterocyclic group (e.g., a benzotriazolyl group, a benzimidazolyl group, or an indazolyl group).

In general formula (N-II), $R^{23}$ and $R^{24}$, which may be the same or different, each represents a hydrogen atom; an alkylsulfonyl group containing not more than about 20 carbon atoms; an arylsulfonyl group containing not more than about 20 carbon atoms (preferably a phenylsulfonyl group, or a phenylsulfonyl group substituted such that the Hamett's $\sigma$ values of its substituent groups are at least $-0.5$ ($-0.5$ to 0 and positive values) in total); or an acyl group containing at least about 20 carbon atoms (preferably, a benzoyl group; a benzoyl group substituted such that the Hamett's $\sigma$ values of its substituent groups are at least $-0.5$ in total; or a straight chain, branched chain or cyclic, unsubstituted or substituted aliphatic acyl group, substituted, e.g., with a halogen atom, an ether group, a sulfonamido group, a carbonamido group, a hydroxy group, a carboxy group, or a sulfo group).

The most preferred $R^{23}$ and $R^{24}$ groups are both a hydrogen atom.

A carbonyl group is the most preferred group represented by G in general formula (N-II).

Preferred compounds represented by general formula (N-II) have a group capable of promoting its adsorption to silver halide grains. Particularly preferred examples of such groups promoting the adsorption of the compound to silver halide grains include a mercapto group, a cyclic thioamido group, a ureido group and a nitrogen-containing heterocyclic group, including those specifically mentioned in the description of general formula (N-I).

Specific examples of the compounds represented by general formula (N-11) are illustrated below, but the present invention is not to be construed as being limited to the following compounds.

(36)

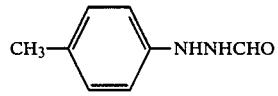

(37)

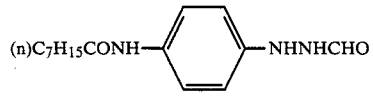

-continued
(38)
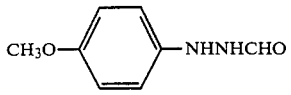
(39)
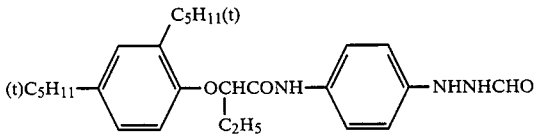
(40)
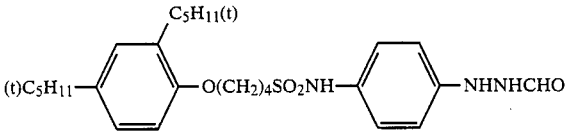
(41)
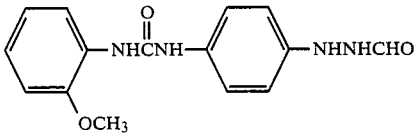
(42)
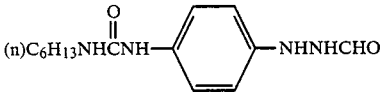
(43)
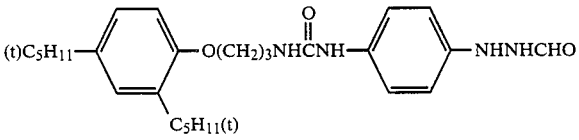
(44)
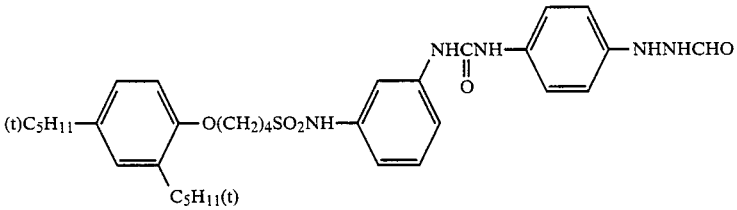
(45)
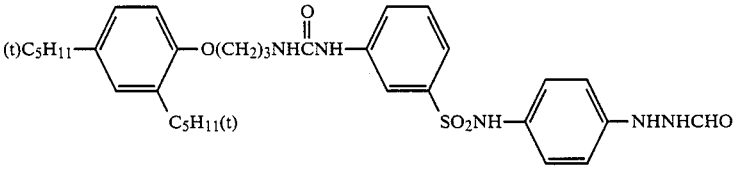
(46)
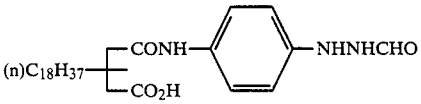
(47)
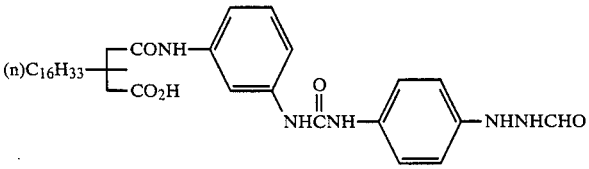

-continued
(48)
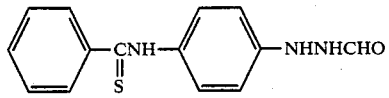
(49)
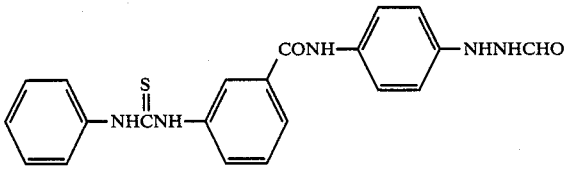
(50)
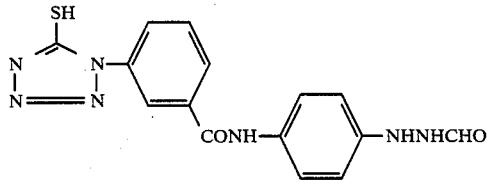
(51)
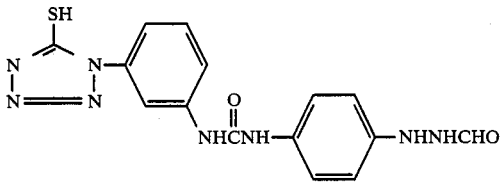
(52)
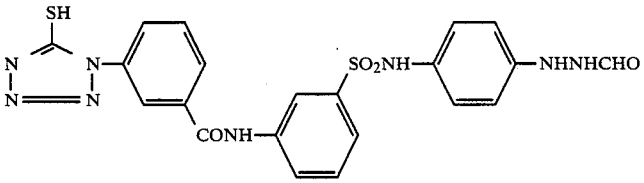
(53)
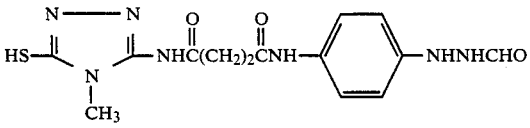
(54)
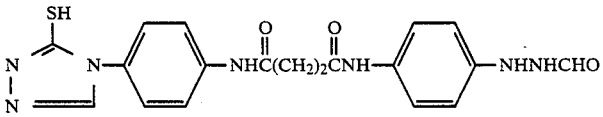
(55)
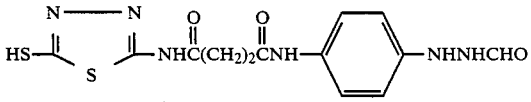
(56)
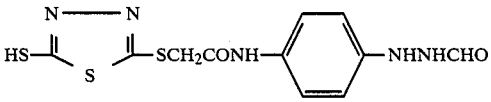
(57)
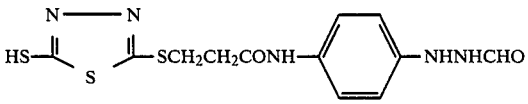
(58)
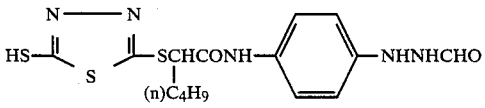

-continued
(59)
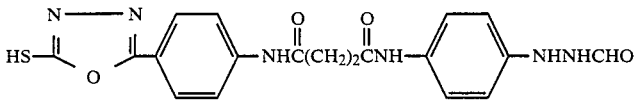
(60)
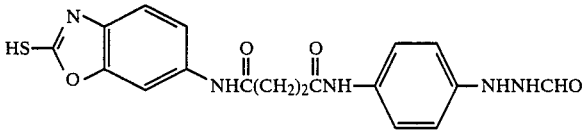
(61)
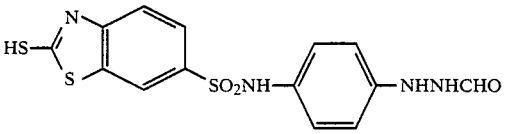
(62)
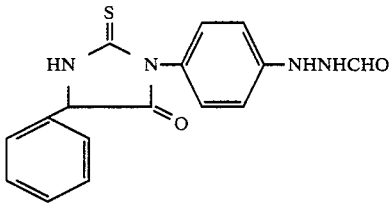
(63)
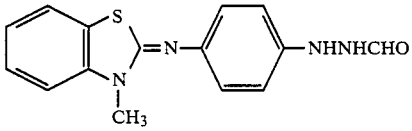
(64)
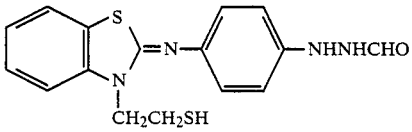
(65)
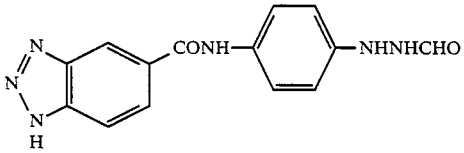
(66)
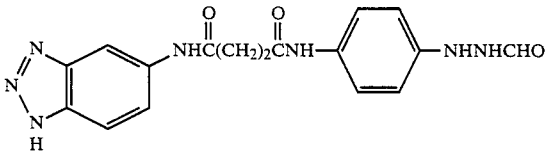
(67)
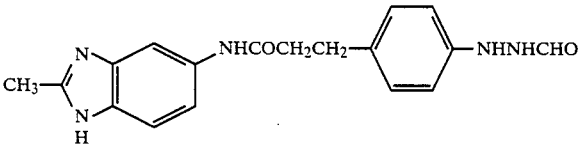
(68)
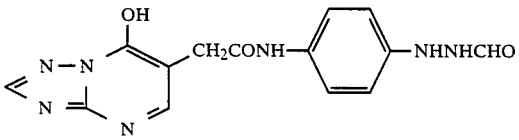

-continued
(69)
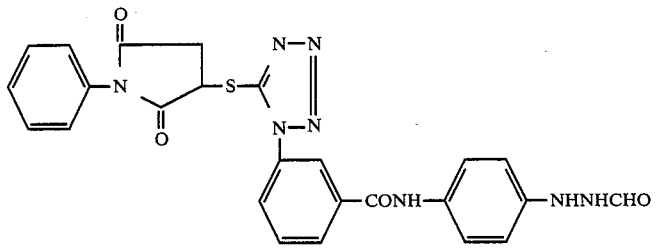
(70)
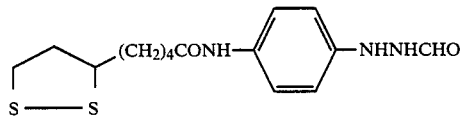
(71)
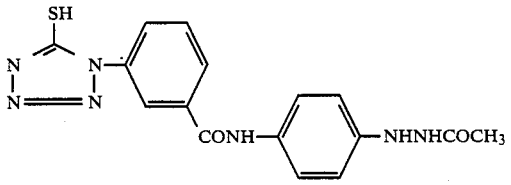
(72)
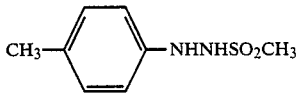
(73)
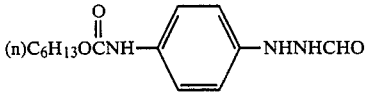
(74)
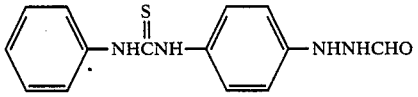
(n)$C_{12}H_{25}$NHNHCHO (75)
(76)
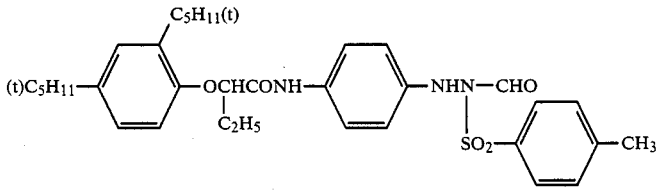
(77)
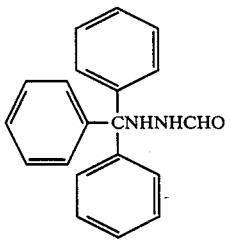
(78)
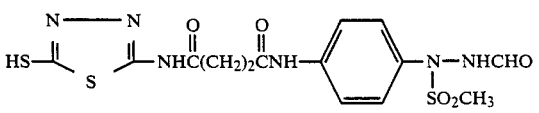

-continued

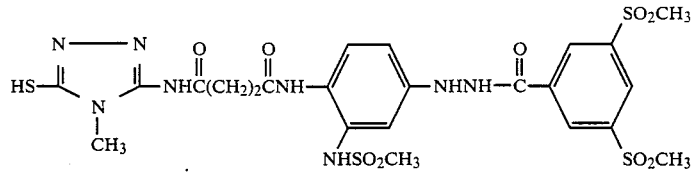

(79)

Syntheses of the compounds represented by general formula (N-II), which are preferably used as nucleating agents in the present invention, are disclosed in the patents cited in *Research Disclosure,* No. 15162, pp. 76–77 (November 1976), No. 22534, pp. 50–54 (January 1982) and No. 23510, pp. 346–352 (November 1983), U.S Pat. Nos. 4,080,207, 4,269,924, 4,276,364, 4,278,748, 4,385,108, 4,459,347, 4,478,928 and 4,560,638, British Pat. No. 2,011,391B, and Japanese Patent Application (OPI) No. 179734/85.

Nucleating agents which have a group capable of promoting their adsorption to silver halide grains are preferred, because they are effective in small amounts.

Preferred examples of nucleating agents in the present invention include hydrazine-type compounds and quaternary heterocyclic compounds and more preferred examples of the nucleating agents include hydrazine-type compounds. Thus it is desired that the nucleation accelerators of the present invention be used in combination with nucleating agents represented by the foregoing general formula (N-I) or nucleating agents represented by the foregoing general formula (N-II), either of which has a mercapto group, an acyclic thioamido group, a cyclic thioamido group or a nitrogen-containing heterocyclic group as a group capable of promoting adsorption to silver halide grains. Nucleating agents of general formula (N-II) having a mercapto group or a nitrogen-containing heterocyclic group are particularly preferred when using p-phenylenediamine-series developers.

In order to further enhance the action of the nucleation accelerators to be used in the present invention, the following compounds can be employed in combination with these nucleation accelerators.

Such compounds include hydroquinones (as described, e.g., in U.S. Pat. Nos. 3,227,552 and 4,279,987); chromans (as described, e.g., in U.S. Pat. No. 4,268,621, Japanese Patent Application (OPI) No. 103031/79, and *Research Disclosure,* No. 18264 (1979); quinones (as described, e.g., in *Research Disclosure,* No. 21206 (1981); amines (as described, e.g., in U.S. Pat. No. 4,150,993, and Japanese Patent Application (OPI) No. 174757/83); oxidizing agents (as described, e.g., in Japanese Patent Application (OPI) No. 260039/85, and *Research Disclosure,* No. 16936 (1978)); catechols (as described, e.g., in Japanese Patent Application (OPI) Nos. 21013/80 and 65944/80); compounds capable of releasing nucleating agents upon development (as described in Japanese Patent Application (OPI) No. 107029/85); thioureas (as described, e.g., in Japanese Patent Application (OPI) No. 95533/85); and spirobisindanes (as described, e.g., in Japanese Patent Application (OPI) No. 65944/80).

In forming direct-positive color images in one process according to the present invention, various color couplers that produce or release substantially nondiffusible dyes upon a coupling reaction with oxidation products of p-phenylenediamine-series color developing agents, while they themselves are substantially nondiffusible. Typical examples of useful nondiffusible color couplers include naphthol-series or phenol-series compounds, pyrazolone-series or pyrazoloazole-series compounds, and open-chain or heterocyclic ketomethylene compounds. Specific examples of cyan, magenta and yellow couplers which can be employed in the present invention are described in the patents cited in *Research Disclosure,* No. 17643, Section VII-D (December 1978) and ibid., No. 18717 (November 1979).

Representatives yellow couplers which can be used in the present invention, include 2-equivalent yellow couplers having an oxygen-atom-linked coupling-off group or a nitrogen-atom-linked coupling-off group. Of these yellow couplers, α-pivaloylacetoanilide-series couplers are particularly advantageous because they can produce dyes excellent in fastness, especially to light, while α-benzoylacetoanilide-series couplers have the advantage of providing high color density in the developed image.

The 5-pyrazolone-series magenta couplers preferably used in the present invention, include those containing an arylamino or acylamino group as a substituent group at the 3-position (particularly 2-equivalent couplers, which have a sulfur-atom-linked coupling-off group.

More preferred magenta couplers are pyrazoloazole-series couplers, especially pyrazolo5,1-c][1,2,4]triazoles described in U.S. Pat. No. 3,725,067, and similar couplers. To reduce yellow sub-absorption and increase light fastness of the developed dyes, imidazo[1,2-b]pyrazoles described in U.S. Pat. No. 4,500,630 are particularly preferred, and pyrazolo[1,5-b][1,2,4]triazoles described in U.S. Pat. No. 4,540,654 are most preferred.

Cyan couplers preferably used in the present invention include phenol-series couplers which have an ethyl or higher alkyl group at the meta-position of the phenol nucleus, described in U.S. Pat. No. 3,772,002. In addition, 2,5-di-acylamino-substituted phenol-series couplers are advantageous in respect of fastness of the dye images produced.

Also, the naphthol-series and phenol-series couplers described in U.S. Pat. Nos. 2,474,293 and 4,052,212, and similar couplers are advantageous in that they have superior coupling activity, and provide dye images having excellent hue and fastness.

In addition to such couplers, the materials used in the present process can contain colored couplers for correction of undesirable absorption exhibited by the dyes formed in the short wavelength region, couplers which can form dyes having a controlled smearing effect as the result of color development, colorless compound forming couplers, DIR couplers which can release development inhibitors depending on the extent of the coupling reaction, couplers capable of releasing development accelerators upon the coupling reaction, and polymerized couplers.

In general, the amount of color coupler used ranges from about 0.001 to 1 mole per mole of light-sensitive halide. Preferably it is within the range of about 0.01 to 0.5 mole of yellow coupler, about 0.003 to 0.5 mole of magenta coupler, and about 0.002 to 0.5 mole of cyan coupler.

A photosensitive material produced in accordance with the present invention may contain as a color fog inhibitor or a color stain inhibitor a hydroquinone derivative, an aminophenol derivative, an amine, a gallic acid derivative, a catechol derivative, an ascorbic acid derivative, a colorless compound forming coupler, a sulfonamidophenol derivative, or other conventional compound.

The photosensitive material of the present invention can contain various discoloration inhibitors, including organic discoloration inhibitors such as hydroquinones, 6-hydroxychromans, 5-hydroxycoumarans, spirochromans, p-alkoxyphenols, hindered phenols containing bisphenols as main members, gallic acid derivatives, methylenedioxybenzenes, aminophenols, hindered amines, and ether or ester derivatives obtained by silylating or alkylating a phenolic hydroxyl group in any of the above-cited compound. In addition, metal complex salts including (bissalicylaldoximato)nickel complexes and (bis-N,N-dialkyldithiocarbamato)nickel complexes can be employed as discoloration inhibitors.

To prevent deterioration of yellow dye images due to heat, moisture and light, compounds containing both hindered amine and hindered phenol moieties in the molecule, described in U.S. Pat. No. 4,268,593, are desirably used. In order to prevent deterioration of magenta dye images particularly due to light, spiroindanes described in Japanese Patent Application (OPI) No. 159644/81, and chromans substituted with a hydroquinone diether or monoether described in Japanese Patent Application (OPI) No. 89835/80 are advantageously employed. These compounds are emulsified together with their corresponding color couplers, and incorporated into their respective light-sensitive layers, generally in proportions of about 5 to 100 wt% of their corresponding couplers. In order to prevent cyan dyes from deteriorating due to heat and light, particularly light, it is effective to introduce an ultraviolet ray absorbent into both layers adjacent to the cyan color-forming layer. In addition, an ultraviolet ray absorbent can be incorporated into a hydrophilic colloid layer such as a protective layer, and so on.

For the binder or the protective colloid contained in emulsion layers and interlayers of the sensitive material of the present invention, gelatin is advantageously used, although any conventional hydrophilic colloids other than gelatin can be used, if desired.

To the sensitive material of the present invention also can be added dyes for prevention of irradiation and antihalation, an ultraviolet ray absorbent, a plasticizer, a brightening agent, a matting agent, an aerial fog inhibitor, a coating aid, a hardener, an antistatic agent, a slippability improving agent and other conventional additives described in *Research Disclosure,* No. 17643 (December 1978) and No. 18716 (November 1979).

The present invention can also be applied to a multilayer multicolor photographic material having at least two different color sensitivities on a support. A multilayer natural color photographic material has, in general, at least one red-sensitive emulsion layer, at least one green-sensitive emulsion layer and at least one blue-sensitive emulsion layer on a support. The order of these layers can be varied as desired. Preferably, a red-sensitive emulsion layer, a green-sensitive emulsion layer and a blue-sensitive emulsion layer are provided in this order on the support, or a blue-sensitive emulsion layer, a red-sensitive emulsion layer and a green-sensitive emulsion layer are provided in this order on the support. Each of the above-described emulsion layers may have two or more layers differing in sensitivity, and a light-insensitive layer may be introduced between any two such layers having the same color sensitivity. Though it is conventional in incorporate a cyan dye-forming coupler in a red-sensitive emulsion layer, a magenta dye-forming coupler in a green-sensitive emulsion layer, and a yellow dye-forming coupler in a blue-sensitive emulsion layer, other combinations can be employed, if desired.

In addition to the above-described silver halide emulsion layers, it is advantageous to provide proper auxiliary layers, such as a protective layer, an interlayer, a filter layer, an antihalation layer, a backing layer, a light-reflecting white layer and so on, in the photosensitive material used in the present invention.

In the photosensitive material used in the present invention, photographic emulsion layers and other layers are coated on any conventionally used flexible support, such as a plastic film, paper, cloth or the like; or a rigid support such as glass, a ceramic, a metal or so on. Useful flexible supports include films made up of semi-synthetic or synthetic high polymers, such as cellulose nitrate, cellulose acetate, cellulose acetate butyrate, polystyrene, polyvinyl chloride, polyethylene terephthalate, polycarbonate and so on, paper coated or laminated with a baryta or an $\alpha$-olefin polymer film (e.g., a polyethylene film, a polypropylene film, an ethylene/butene copolymer film, etc.), and the like. A support may be colored with dyes or pigments. For the purpose of shielding light, the support may be blackened. In general, the surfaces of the above-cited supports undergo a subbing treatment in order to heighten adhesiveness to photographic emulsion layers. Also, the support surfaces may be treated by glow discharge, corona discharge, ultraviolet irradiation, flame processing or the like before or after the subbing treatment.

In coating silver halide photographic emulsion layers and other hydrophilic colloid layers, various known coating techniques, e.g., dip coating, roller coating, curtain coating, extrusion coating and so on, can be used.

When the process of the present invention is applied to the color diffusion transfer process, dye developers can be employed as a color material. However, it is more advantageous to use color materials of the type which themselves are nondiffusible (immobile) under alkaline conditions (in a developing solution), capable of releasing diffusible dyes (or precursors thereof) as the result of development. The diffusible dye releasing color materials of the above-described type (DDR compounds) include diffusible dye releasing couplers, redox compounds and so on. These color materials are useful not only in the color diffusion transfer process (wet process), but also in heat developable photosensitive materials as described, e.g., in Japanese Patent Application (OPI) No. 58543/83 (dry process).

Useful diffusible dye releasing redox compounds (hereinafter referred to as "DRR compounds") are represented by the following general formula:

(Ballast)-(redox-cleavable atomic group)-D

In the formula, D represents a dye moiety (or a precursor thereof). The dye moiety may be bonded to the redox cleavable atomic group through a linkage group.

Effective dyes in the dye moiety represented by D include the yellow dyes described in U.S. Pat. Nos. 3,597,200, 3,309,199, 4,013,633, 4,245,028, 4,156,609, 4,139,383, 4,195,992, 4,148,641, 4,148,643 and 4,336,322, Japanese Patent Application (OPI) Nos. 114930/76 and 71072/81, *Research Disclosure,* No. 17630 (December 1978), and No. 16475 (December 1977).

Examples of magenta dyes that can be used as D include those disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, and Japanese Patent Application (OPI) Nos. 106727/77, 23628/78, 36804/80, 73057/81, 71060/81 and 134/80.

D can also be a cyan dye such as those described in U.S. Pat. Nos. 3,482,972, 3,929,760, 4,013,635, 4,268,625, 4,171,220, 4,242,435, 4,142,891, 4,195,994, 4,147,544 and 4,148,642, British Pat. No. 1,551,138, Japanese Patent Application (OPI) Nos. 99431/79, 8827/77, 47823/78, 143323/78, 99431/79 and 71061/81, European Pat. Nos. 53,037 and 53,040, *Research Disclosure,* No. 17630 (December 1978), and No. 16475 (December 1977).

Among the diffusible dye releasing redox compounds, examples of those compounds whose oxidized products release dyes upon alkali hydrolysis include the compounds described in U.S. Pat. Nos. 4,053,312, 4,055,428, 4,076,529, 4,152,153 and 4,135,929, and Japanese Patent Application (OPI) Nos. 149328/78, 104343/76, 46730/78, 130122/79, 3819/78, 12642/81, 16130/81 and 16131/81; and examples of those compounds which release dyes upon ring closure, and the like include the compounds described in U.S. Pat. Nos. 4,139,379 and 3,980,479 and West German Patent Application (OLS) Nos. 2,402,900 and 2,448,811.

Suitable coverage of such DDR compounds is generally from about $1\times10^{-4}$ to about $1\times10^{-2}$ mole/m$^2$, preferably from about $2\times10^{-4}$ to $2\times10^{-2}$ mole/m$^2$.

The color materials used in the present invention may be incorporated in silver halide emulsion layers to be associated therewith, or in layers adjacent to such emulsion layers on the exposure side or on the side opposite thereto.

When the process of the present invention is applied to the color diffusion transfer process, photographic emulsions may be coated in an integrated form on the same support as the image-receiving layer, or may be coated on a different support from the image-receiving layer. That is, the silver halide photographic emulsion layers (light-sensitive element) and the image-receiving layer (image-receiving element) may be provided in an integrated form as a film unit, or may separate photographic materials. The film unit may have an integrated structure throughout the process including exposure, development, transfer of images and final form, or a structure requiring the image-receiving element to be peeled apart after development. A peel-apart structure is more effectively used in the present invention.

The present invention can be applied to various color photographic materials, including color reversal films for slide use or television use, color reversal paper, instant color films and so on. Also, the present invention can be applied to color hard copies for preserving images produced with a full-color copying machine or CRT, and the like. In addition, the present invention can be applied to black-and-white photographic materials of the type which utilize a process of mixing three color couplers, as described in *Research Disclosure,* No. 17123 (July, 1978), and so on.

Moreover, the present invention can be applied to black-and-white photographic materials, such as the black-and-white direct-positive photographic materials described in Japanese Patent Application (OPI) Nos. 208540/84 and 260039/85 (e.g., X-ray sensitive materials, duplicating photosensitive materials, microphotographic materials, photo-composing photographic materials, photographic materials for graphic arts, etc.

The color developing solution to be used in the present invention for development-processing of a photosensitive material containing nondiffusible couplers is an alkaline aqueous solution which contains no substantial amount of any silver halide solvent and contains as a main component a color developing agent, preferably of the aromatic primary amine-series. Of such developing agents, aminophenol-series compounds can be used and p-phenylenediamine-series compound are preferred. Preferred p-phenylenediamine type developing agents include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides, phosphates, p-toluenesulfonates, tetraphenylborates or p-(t-octyl)-benzenesulfonates of the above-cited anilines. These diamines are, in general, more stable in the salt form than in the free state, and are preferably in the form of salt.

Suitable examples of aminophenol derivatives include o-aminophenol, p-aminophenol, 4-amino-2-methylphenol, 2-amino-3-methylphenol, 2-oxy-3-amino-1,4-dimethylbenzene and the like.

In addition to the above-cited color developing agents, those described in L. F. A. Mason, *Photographic Processing Chemistry,* pp. 226–229 (Focal Press, 1966), U.S. Pat. Nos. 2,193,015 and 2,592,364, Japanese patent application (OPI) No. 64933/73, and so on may be used. Two or more color developing agents can be used in combination, if desired.

The color developing agent as set forth above is generally used in a concentration of about 0.1 g to about 30 g per liter of color developing solution, and more preferably about 1 g to about 15 g per liter of color developer. The amount of the color developer replenished after processing can be reduced by using a replenisher containing properly adjusted amounts of halides, a color developing agent and so on.

The color developer can further contain particular antifoggants and development inhibitors. Also, these additives for a developing solution can be incorporated into any desired layers of the photographic material. In general, antifoggants useful herein include heterocyclic thiones, aromatic and aliphatic mercapto compounds, and so on. Useful compounds include tetraazaindenes, benzotriazoles, benzimidazoles, benzothiazoles, benzoxazoles, 1-phenyl-5-mercaptotetrazoles and the like.

Specific examples of tetraazaindenes which can be effectively used in the present invention include 4-hydroxy-1,3,3a,7-tetraazaindene, 4-hydroxy-6-methyl-1,3,3a,7-tetraazaindene, 4-methyl-5-hydroxy-1,3,3a,7-tetraazaindene, 4-hyroxy-6-butyl-1,3,3a,7-tetraazaindene, 4-hydroxy-3,6-dimethyl-1,3,3a,7-tetraazaindene, 2-ethyl-4-hydroxy-6-propyl-1,3,3a,7-tetraazaindene, 2-allyl-4-hydroxy-1,3,3a,7-tetraazaindene, 4-hydroxy-6-phenyl-1,3,3a,7-tetraazaindene, 2-propyl-4-hydroxy-6-phenyl-1,3,3a,7-tetraazaindene, 2-mercaptomethyl-4-hydroxy-6-methyl-1,3,3a,7-tetraazaindene, 4-hydroxy-5,6-tetramethylene-1,3,3a,7-tetraazaindene, and the like.

Specific examples of benzindazoles which are effectively used in the present invention include benzindazole, 5-methyl-benzindazole, 6-nitro-benzindazole, 3-methyl-5-nitro-benzindazole, 5,6-dinitro-benzindazole, 5-chloro-benzindazole, 6-bromo-benzindazole, 5,6-dichloro-benzindazole, 6-hydroxy-benzindazole, 6-carboxy-benzindazole, 6-methoxybenzindazole, 6-amino-benzindazole, and similar compounds.

Specific examples of benzotriazoles which are effectively used in the present invention include benzotriazole, 4-methyl-benzotriazole, 5-methyl-benzotriazole, 5-chloro-benzotriazole, 5-bromo-benzotriazole, 5-nitro-benzotriazole, 5-amino-benzotriazole, 5-sulfo-benzotriazole, 5-hydroxy-benzotriazole, 5-carboxy-benzotriazole, 5-trifluoromethyl-benzotriazole, and like compounds.

These antifoggants can be used in combination of two or more thereof, and are incorporated in a color developer in an amount of preferably from about 0.1 mg/l to 5 g/l. In particular, tetraazaindenes, benzindazoles, benzotriazoles or benzimidazoles are added to a color developer in an amount of about 1 mg/l to 5 g/l.

In addition, bromides and iodides can be used as development inhibitors in the developing solution of the present invention in a conventional manner.

The color developer can contain a pH buffering agent, such as carbonates, borates or phosphates of alkali metals; a preservative, such as hydroxylamines, triethanolamines, the compounds described in West German patent application (OLS) No. 2,633,950, sulfites, or bisulfites; an organic solvent, such as diethylene glycol; a development accelerator, such as benzyl alcohol, polyethylene glycol, quaternary ammonium salts, amines, thiocyanates, or 3,6-thiaoctane-1,3-diol; a brightening agent of the stilbene-series or others; dye-forming couplers; competing couplers; a nucleating agent such as sodium borohydride; an auxiliary developing agent such as 1-phenyl-3-pyrazolidone; a viscosity imparting agent; and a chelating agent, such as aminopolycarboxylic acids including ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and the compounds described in Japanese patent application (OPI) No. 195845/83, 1-hydroxyethylidene-1,1-diphosphonic acid, organic phosphonic acids described in *Research Disclosure,* No. 18170 (May, 1979), aminophosphonic acids such as aminotris(methylenephosphonic acid), and ethylenediamine-N,N,N',N'-tetramethylenephosphonic acid, phosphonocarboxylic acids described in Japanese patent application (OPI) Nos. 102726/77, 42730/78, 121127/79, 4024/80, 4025/80, 126241/80, 65955/80, and 65956/80, and *Research Disclosure,* No. 18170 (May, 1979), and other conventional chelating agents.

The appropriate pH of the color developer is generally about 7 or higher, preferably about 9 to about 13, more preferably about 10 to 12, and particularly preferably about 10 to 11.5.

A color developing agent or a precursor thereof may be incorporated in the silver halide color photographic material used in the present invention in order to simplify and speed up photographic processing. Incorporation of a color developing agent in the form of precursor is preferable since it can enhance the stability of the photographic material. Specific examples of developing agent precursors which can be employed in the present invention include indoaniline-series compounds described in U.S. Pat. No. 3,342,597; Schiff base-series compounds described in U.S. Pat. No. 3,342,599, *Research Disclosure,* No. 14850 (August 1976), and No. 15159 (November 1976); aldol compounds described in *Research Disclosure,* No. 13924 (November 1975); metal complex salts described in U.S. Pat. No. 3,719,492; urethane-series compounds described in Japanese patent application (OPI) No. 135628/78; and various salts described in Japanese patent application (OPI) Nos. 6235/81, 16133/81, 59232/81, 67842/81; 83734/81, 83735/81, 83736/81, 89735/81, 81837/81, 54430/81, 106241/81, 107236/81, 97531/82 and 83565/82, and other conventional precursors.

The silver halide color photographic material of the present invention may contain various 1-phenyl-3-pyrazolidones for the purpose of promoting color development, including those described in Japanese patent application (OPI) Nos. 64339/81, 144547/82, 211147/82, 50532/83, 50536/83, 50533/83, 50534/83, 50535/83 and 115438/83.

After color development, the photographic emulsion layers are, in general, subjected to conventional bleach processing. The bleach processing may be carried out simultaneously with fixation processing in a combined bleaching and fixing bath (a blix bath), or separately form fixation processing. To further shorten photographic processing, bleach-fix processing may be carried out after either bleach processing or the fix processing.

Suitable examples of bleaching agents which can be used in bleaching or bleach-fix processing include compounds of polyvalent metals such as Fe(III), Co(III), Cr(VI), Co(II), etc. (e.g., ferricyanide); peroxy acids; quinones; nitroso compounds; dichromates; organic complex salts of Fe(III) or Co(III), e.g., complex salts of aminopolycarboxylic acids, such as ethylenediaminetetraacetic acid, diethylenetriaminepentaacetic acid, etc., aminopolyphosphonic acids, phosphonocarboxylic acids, organic phosphonic acids, and so on), and organic acids, such as citric acid, tartaric acid, malic acid, etc.; persulfates; hydrogen peroxide; permanganates; and so on. Of these bleaching agents, organic complex salts of Fe(III) and persulfates are preferred over others from the standpoint of rapid of processing and the prevention of environmental pollution. Useful aminopolycarboxylic acids, aminopolyphosphonic acids and the respective salts for forming organic complex salts of Fe(III) include the following:

Ethylenediaminetetraacetic acid,
Diethylenetriaminepentaacetic acid,
Ethylenediamine-N-(β-oxyethyl)-N,N,N',N'-triacetic acid,
1,2-Diaminopropanetetraacetic acid,
Triethylenetetraminehexaacetic acid,
Propylenediaminetetraacetic acid,
Nitrilotriacetic acid,
Nitrilotripropionic acid,
Cyclohexanediaminetetraacetic acid,
1,3-Diamino-2-propanoltetraacetic acid,
Methyliminodiacetic acid,
Iminodiacetic acid,
Hydroxyliminodiacetic acid,
Dihydroxyethylglycine ethyl ether diamine tetraacetic acid,
Glycol ether diamine tetraacetic acid, Ethylenediaminetetrapropionic acid,
Ethylenediaminedipropionylacetic acid,
Phenylenediaminetetraacetic acid,
2-Phosphonobutane-1,2,4-triacetic acid,
1,3-diaminopropanol-N,N,N',N'-tetramethylenephosphonic acid,
Ethylenediamine-N,N,N',N'-tetramethylenephosphonic acid,
1,3-Propylenediamine-N,N,N',N'-tetramethylenephosphonic acid, and
1-Hydroxyethylidene-1,1'-diphosphonic acid.

Of these compounds, Fe(III) complex salts of ethylenediaminetetraacetic acid, diethylenetriaminepentaacetic acid, cyclohexanediaminetetraacetic acid, 1,2-diaminopropanetetraacetic acid and methylaminodiacetic acid are preferred because of their high bleaching power.

As for the Fe(III) complex salts, one or more of a pre-manufactured complex salt may be used, or a ferric ion complex salt may be produced in the solution by reacting a Fe(III) salt (e.g., ferric sulfate, ferric chloride, ferric nitrate, ammonium ferric sulfate, ferric phosphate, etc.) with a chelating agent (e.g., an aminopolycarboxylic acid, an aminopolyphosphonic acid, a phosphonocarboxylic acid, etc.). When forming a complex salt in solution, either or both of a ferric salt and a chelating agent may be used in the form a mixture. In either the case of a pre-manufactured complex salt or in-solution complexation, the chelating agent may be used in an amount greater than the stoichiometric amount. In addition to the foregoing ferric ion complexes, the bleaching solution or the bleach-fix solution may contain metal ions, such as calcium, magnesium, aluminium, nickel, bismuth, zinc, tungsten, cobalt, copper and like ions, complex salts of these metal ions, or hydrogen peroxide.

Suitable examples of persulfates that can be used in bleach processing or blix processing in the present invention include alkali metal persulfates, such as potassium persulfate, sodium persulfate, etc., ammonium persulfate, and so on.

The bleaching solution or the bleach-fix solution can contain a rehalogenating agent, such as a bromide (e.g., potassium bromide, sodium bromide or ammonium bromide), a chloride (e.g., potassium chloride, sodium chloride or ammonium chloride), or an iodide (e.g., ammonium iodide). Optionally, the bleaching or bleach-fix solution can also contain one or more of an inorganic acid, an organic acid, or an alkali metal or ammonium salt thereof, which has a pH buffering capacity, including boric acid, borax, sodium metaborate, acetic acid, sodium acetate, sodium carbonate, potassium carbonate, phosphorous acid, phosphoric acid, sodium phosphate, citric acid, sodium citrate, tartaric acid and so on; and a corrosion inhibitor such as ammonium nitrate or guanidine.

A suitable content of bleaching agent is about 0.1 to 2 mole per 1 liter of bleaching solution. A preferred pH of the bleaching solution is within the range of about 0.5 to 8.0 when using ferric ion complex salts, particularly of about 4.0 to 7.0, when using complex salts formed by ferric ions and aminopolycarboxylic acids, aminopolyphosphonic acid, phosphonocarboxylic acid or organic phosphonic acids. When using persulfates, a suitable concentration is about 0.1 to 2 mol/l, and the preferred pH range is from about 1 to 5.

Any known fixing agents can be used in the present invention for fixation or bleach-fix processing, including thiosulfates such as sodium thiosulfate, ammonium thiosulfate, etc., thiocyanates such as sodium thiocyanate, ammonium thiocyanate, etc., and water-soluble silver halide solvents, such as thioether compounds (e.g., ethylenebisthioglycolic acid, 3,6-dithia-1,3-octanediol, etc., thioureas, and so on. These fixing agents can be used alone or as a mixture of two or more thereof. In addition, special bleach-fix solutions containing combinations of the fixing agents described in Japanese patent application (OPI) No. 155354/80 and large amounts of halides such as potassium iodide, can be used in bleach-fix processing.

In fixation or bleach-fix processing, a desirable concentration of the fixing agent used is from about 0.2 to 4 mol/l. In bleach-fix processing, a desirable concentration of the ferric ion complex salt is within the range of about 0.1 to 2 mole per 1 liter of bleach-fix solution, and the concentration of fixing agent is within the range of about 0.2 to 4 mol/l. The fixing solution and the bleach-fix solution are adjusted generally to a pH of about 4.0 to 9.0, particularly preferably about pH 5.0 to 8.0.

The fixing solution or the bleach-fix solution can contain as preservatives, in addition to the above-described additives which can be added to the bleaching solution, sulfites (e.g., sodium sulfite, potassium sulfite, and ammonium sulfite), bisulfites, hydroxylamines, hydrazines, adducts of bisulfites, and aldehyde compounds (e.g., acetoaldehyde-sodium bisulfite adduct), and so on. Further, these solutions can contain various conventional brightening agents, defoaming agents, surface active agents, polyvinyl pyrrolidone, and organic solvents such as methanol, if desired.

Bleach accelerators can be used in the bleaching bath, the blix bath, or pre-baths thereof, if desired. Specific examples of useful bleach accelerators include compounds having a mercapto group or a disulfide group, as described in U.S. Pat. No. 3,893,858, West German Pat. Nos. 1,290,812 and 2,059,988, Japanese patent application (OPI) Nos. 32736/78, 57831/78, 37418/78, 65732/78, 72623/78, 95630/78, 95630/78, 95631/78, 104232/78, 124424/78, 141623/78 and 28426/78, *Research Disclosure,* No. 17129 (July, 1978); thiazolidine derivatives as described in Japanese patent application (OPI) No. 40129/75; thiourea derivatives as described in Japanese patent publication No. 8506/70, Japanese patent application (OPI) Nos. 20832/77 and 32735/78, and U.S. Pat. No. 3,706,561; iodides described in West German Pat. No. 1,127,715, and Japanese patent application (OPI) No. 16235/83; polyethyleneoxides described in West German Pat. Nos. 966,410 and 2,748,430; polyamine compounds described in Japanese patent publication No. 8836/70; compounds described in Japanese patent application (OPI) Nos. 42434/74, 59644/74, 94927/78, 35727/79, 26506/80 and 162940/83; and iodine and bromine ions. Of these substances, compounds containing a mercapto group or a disulfido group are advantageous since they have a greater accelerating effect. In particular, the compounds described in U.S. Pat. No. 3,893,858, West German Pat. No. 1,290,812 and Japanese patent application (OPI) No. 95630/78 are desirable. In addition, the compounds described in U.S. Pat. No. 4,552,834 are advantageously used. These bleach accelerators also may be incorporated into the photosensitive material.

After fixing or bleach-fix processing, washing and stabilization processing are generally carried out.

In the steps of washing and stabilization, various known compounds may be added for the purposes of preventing precipitation and stabilizing the washing water. More specifically, chelating agent such as inorganic phosphoric acids, aminopolycarboxylic acids, organic phosphonic acids, and the like; germicides and bactericides for inhibiting various bacteria, algae and molds from breaking out (e.g., compounds described in *J. Antibact. Antifung. Agents,* Vol. 11, No. 5, pp. 207–223 (1983), and compounds described in Hiroshi Horiguchi, *Bokin Bobi no Kagaku* (Antibacerial and Antimold Chemistry); metal salts such as magnesium salts, aluminium salts, bismuth salts and the like, alkali metal salts, and ammonium salts; surface active agents for facilitating drying and preventing drying marks; and so on can be added, as desired. Also, the compounds described in L. E. West, *Photo. Sci. Eng.,* Vol. 6, pp. 344–359 (1965) may be added. In particular, the addition of chelating agents, and of bactericidal and antimold agent are effective.

The washing step is, in general, carried out using two or more tanks (for example, 2 to 9 tanks) according to the counter current washing method for the purpose of saving water. On the other hand, a multistage counter current stabilization-processing step as described in Japanese patent application (OPI) No. 8543/82 may be carried out in place of the washing step. To the stabilizing bath are added various compounds, other than the above-described additives, in order to stabilize the developed images, including buffering agents for adjusting film pH to a proper value (ranging generally from about 3 to 9), such as those prepared by proper combinations of acids and alkalis selecting from among borates, metaborates, borax, phosphates, carbonates, potassium hydroxide, sodium hydroxide, aqueous ammonia, monocarboxylic acids, dicarboxylic acids, polycarboxylic acids and the like; and aldehydes represented by formaldehyde. The stabilizing bath may further contain a chelating agent (e.g., inorganic phosphoric acids, aminopolycarboxylic acids, organic phosphonic acids, aminopolyphosphonic acids, phosphocarboxylic acids, etc.), a germicide and antimold agent (e.g., thiazole-series agents, isothiazole-series agents, halogenated phenols, sulfanylamides, benzotriazoles, and so on, a surface active agent, a brightening agent, a metal salt hardener, and various other additives, if desired. Two or more compounds may be used for the same purpose or different purposes.

In addition, it is preferred that any of various ammonium salts, such as ammonium chloride, ammonium nitrate, ammonium sulfate, ammonium phosphate, ammonium sulfite, ammonium thiosulfate and the like, be added to the stabilizing bath in order to control the pH in the processed film to improve image keeping quality.

Suitable washing and stabilization times, though dependent on the kind of photosensitive material and processing conditions, are generally within the range of about 20 seconds to 10 minutes, preferably within the range of about 20 seconds to 5 minutes.

Each processing solution in the present invention is used at a temperature of about 10° C. to 50° C. Although standard temperatures for processing steps are within the range of about 33° C. to 38° C., processing can be accelerated by carrying out them at higher temperature to reduce processing time, while processing at lower temperatures enable improvement in image quality and enhancement of the stability of processing solutions used.

Also, each processing step can be shortened from the standard time, if no adverse effect occurs, if desired to reduce photographic processing time.

When running (continuous) processing is carried out, variation in the composition of each processing solution can be prevented by using a replenisher to obtain a constant result.

In each processing, conventional equipment can be used, including, e.g., a heater, a temperature sensor, a liquid level sensor, a circular pump, a filter, various kinds of floating lids, various kinds of squeezers, and so on.

When DRR compounds are employed in the present invention, any silver halide developer or electron-donating agent capable of undergoing a cross-oxidation reaction with the DRR compounds, can be used in the developing solution. Such a developer may be added to an alkaline solution for development processing, or may be incorporated in an appropriate layer of a photographic element.

Specific examples of developers which can be used in the present invention include hydroquinone, aminophenols such as N-methylaminophenol, 1-phenyl-3-pyrazolidinone, 1-phenyl-4,4-dimethyl-3-pyrazolidinone, 1-phenyl-4-methyl-4-oxymethyl-3-pyrazolidinone, N,N-diethyl-p-phenylenediamine, 3-methyl-N,N-diethyl-p-phenylenediamine, 3-methoxy-N-ethoxy-p-phenylenediamine, and so on.

Of these developers, black-and-white developers are particularly advantageous, as in the case of the foregoing alkaline development-processing solution, because they generally reduce stain formation in an image-receiving layer (mordanting layer).

When the photosensitive material of the present invention is applied to a film unit for the diffusion transfer process, it is preferable to process the material with a viscous developer. Such a viscous developer is a liquid composition containing processing ingredients necessary for development of silver halide emulsions (and formation of diffusion transferred dye images), and containing water as a main solvent. Optionally, a hydrophilic solvent, such as methanol, methyl cellosolve or the like may be present in addition to water. Preferably, the processing composition contains a hydrophilic polymer, e.g., polyvinyl alcohol having a high molecular weight, hydroxyethyl cellulose, sodium carboxymethyl cellulose, or the like, in quantities sufficient to impart a viscosity of above about 1 poise, preferably from about 500 to about 1,000 poises, when the processing composition is at room temperature.

The above-described processing composition is preferably charged in a pressure-rupturable container for use as described in U.S. Pat. Nos. 2,543,181, 2,643,886, 6,253,732, 2,723,051, 3,056,491, 3,056,492 and 3,152,515.

Various developing agents can be used for development of a black-and-white photosensitive material in the present invention, including polyhydroxybenzenes, such as hydroquinone, 2-chlorohydroquinone, 2-methylhydroquinone, catechol, pyrogallol, etc.; aminophenols, such as p-aminophenol, N-methyl-p-aminophenol, 2,4-diaminophenol, etc.; 3-pyrazolidones, such as 1-phenyl-3-pyrazolidone, 1-phenyl-4,4′-dimethyl-3-pyrazolidone, 1-phenyl-4-methyl-4-hydroxymethyl-3-pyrazolidone, 5,5-dimethyl-1-phenyl-3-pyrazolidone, etc.; and ascorbic acid. These developers can be used alone or in a combination of two or more thereof. In addition, the developer described in Japanese patent application (OPI) No. 55928/83 can be employed.

These developing agents may be added to the alkaline processing composition (processing element), or may be incorporated in an appropriate layer of the photosensitive element.

The developer may contain, as a preservative, sodium sulfite, potassium sulfite, ascorbic acid, reductones (e.g., piperidinohexose reductone), or so on.

The photosensitive material of the present invention is developed with a surface developer to produce a direct-positive image. The term "surface developer" refers to a class of well-known conventional developers that substantially cause development of latent images or fogged nuclei present at the individual surfaces of silver halide grains. It is preferred that such a developer not contain any silver halide solvent. However, it may contain some silver halide solvent (e.g., sulfites) so far as internal latent images do not substantially contribute to development until the development attributed to surface development centers of silver halide grains is completed.

The developer may contain, as an alkali agent or a pH buffering agent, sodium hydroxide, potassium hydroxide, sodium carbonate, potassium carbonate, trisodium phosphate, sodium metaphosphate, or the like, in an amount to adjust the pH of the developer to about 9 to 13, preferably about 10 to 11.5.

In addition, it is advantageous for further lowering the minimum density of direct-positive images for the developer to contain a conventional antifoggant, including benzimidazoles, e.g., 5-nitrobenzimidazole; and benzotriazole, e.g., 5-methyl-benzotriazole.

Specific examples and detailed usages of developers, preservatives, buffering agents and developing methods which can be employed for black-and-white photosensitive materials are described in *Research Disclosure,* No. 17643, XIX–XXI (December 1978).

The present invention will be explained in greater detail with reference to the following examples, but the present invention is not to be construed as being limited thereto. Unless otherwise indicated, all parts, percents and ratios are by weight.

The following emulsions A, B, C and D were prepared for use in the Examples.

EMULSION A 0.3 l of an aqueous solution containing 0.5 mol/l of potassium bromide and 0.28 l of an aqueous solution containing 0.5 mol/l of silver nitrate were simultaneously added to 0.6 l of an aqueous 8% gelatin solution in which 3,4-dimethyl-1,3-thiazolidine-2-thione was contained in a concentration of 0.3 g/mole Ag with vigorous stirring at 75° C. over a period of 20 minutes to produce a monodisperse octahedral silver bromide emulsion having a mean grain size of 0.4 micron. The emulsion obtained was chemically sensitized by adding sodium thiosulfate and chloroauric acid (tetrahydrate) each in an amount of 6 mg per mole of silver, followed by heating at 75° C. for 80 minutes. The resulting silver bromide grains were used as a core, upon which an additional layer of silver bromide was grown by treating the grains for an additional 40 minutes under the same precipitation conditions as in the first silver bromide formation step above, to obtain a monodisperse octahedral core/shell silver bromide emulsion having a mean grain size of 0.7 micron. After washing and desalting, sodium thiosulfate and chloroauric acid (tetrahydrate) were added to the emulsion each in an amount of 1.5 mg per mole silver, and the emulsion was chemically sensitized by heating at 60° C. for 60 minutes. Thus, an internal latent-image type silver halide emulsion A was prepared.

EMULSION B

To a 1 liter portion of a mixed solution containing 0.5 mol/l of KBr, 0.2 mol/l of NaCl and 0.0015 mol/l of KI, 30 g of gelatin was added and dissolved. To this solution, 700 ml of an aqueous solution containing silver nitrate in a concentration of 1 mol/l was added at 60° C. over a period of 20 minutes after which it was further physically ripened for 20 minutes.

Then, water soluble halides were removed from the emulsion by washing. Thereafter, 20 g of gelatin was added, and water was further added to bring the total volume to 1,200 ml. A silver halide emulsion having a mean grain size of 0.4 micron was obtained.

To a 300 ml portion of the resulting emulsion, were simultaneously added at 60° C. a 500 ml portion of an aqueous solution containing 1 mol/l of silver nitrate and a 500 ml portion of an aqueous solution containing 2 mol/l of sodium chloride, precipitating a silver chloride shell onto the previously formed grains. After washing with water, a silver halide emulsion B having a mean grain size of 0.7 micron was obtained.

EMULSION C 0.5 l of an aqueous solution of potassium bromide (0.4 mol/l) and 0.5 l of an aqueous solution of silver nitrate (0.38 mol/l) were added simultaneously to 0.6 l of an aqueous 7% solution of gelatin with vigorous stirring at 75° C. over a period of 90 minutes to produce an octahedral silver bromide emulsion having a mean grain size of about 0.8 micron (core grains). Additionally, 0.65 g of 3,4-dimethyl-1,3-thiazoline-2-thione was added to the aqueous solution of gelatin prior to the precipitation of silver halide grains, and pH and pAg were maintained at about 6 and about 8.7, respectively, during the course of the precipitation. The resulting silver bromide grains were chemically sensitized by adding thereto 3.4 mg of sodium thiosulfate and 3.4 mg of potassium chloroaurate per 1 mole of silver. A shell was then grown on the individual surfaces of the chemically sensitized grains by repeating the same precipitating conditions used to form the core grains, to produce octahedral core/shell silver bromide grains having a mean grain size of 1.2 micron. Thereto, $9.6\times10^{-4}$ mol of potassium iodide per mol of silver and $4.2\times10^{-2}$ g of N-vinylpyrrolidone polymer (weight average molecular weight: 38,000) per mole of silver were further added to prepare an emulsion C.

EMULSION D 0.3 l of an aqueous solution containing 0.4 mol/l of potassium bromide and 0.28 l of an aqueous solution containing 0.4 mol/l of silver nitrate were added simultaneously to 0.6 l of an 8% aqueous gelatin solution containing 0.01 mol/l of potassium bromide with vigorous stirring at 75° C. over a period of 60 minutes to yield a silver bromide emulsion. Before precipitation using the double-jet process, 3,4-dimethyl-1,3-thiazoline-2-thione and benzimidazole were added as silver halide solvents in amounts of 150 mg and 15 g, respectively, per 1 mole of silver. At the conclusion of the precipitation, octahedral silver halide grains having almost equal grain sizes (mean grain size: about 0.8 micron) were formed. The resulting grains were chemically sensitized by adding thereto sodium thiosulfate and potassium chloroaurate in amounts of 4.8 mg and 2.4 mg, respectively, per 1 mole of silver, and then by heating them at 75° C. for 80 minutes. To the thus chemically sensitized silver bromide emulsion containing internal nuclei (core) grains were added simultaneously aqueous solutions of potassium bromide and silver nitrate over a period of 45 minutes, all other conditions being the same as during the first grain formation, to produce a core/-shell silver bromide emulsion of the internal latent image type. 2.5 g of hydrogen peroxide per mol Ag was further added as an oxidizing agent, and the emulsion was heated at 75° C. for 8 minutes, followed by washing with water, to obtain an emulsion having a mean grain size of 1.0 micron.

To the thus obtained emulsion, 0.75 mg of sodium thiosulfate per mol Ag and 20 mg of poly(N-vinylpyrrolidone) per mol Ag were added, followed by heating at 60° C. for 60 minutes to chemically sensitize (ripen) the grain surface, and obtain an emulsion D.

EXAMPLE 1

Coating compositions prepared in the following manner were each coated on separate paper supports laminated with polyethylene on both sides to prepare color photographic paper Nos. 1 to 20, respectively.

Preparation of Coating Compositions 9 g of magenta coupler (e) and 3.0 g of color image stabilizer (f) were placed in a vessel, and thereto were added 10 ml of ethyl acetate and 9 ml of solvent (g) to prepare a solution. The solution was dispersed, in an emulsified condition, into 100 ml of a 10% aqueous gelatin solution containing sodium dodecylbenzenesulfonate in a concentration of 10%. The resulting emulsified dispersion was mixed with 133 g of the foregoing internal latent-image type core/shell-form silver halide emulsion A (containing $3.5\times10^{-4}$ mol/mol Ag of a green-sensitive spectral sensitizing dye and 5.5 g/mol Ag of an anti-irradiation dye. Then, the resulting emulsion was so adjusted as to have the composition shown in Table 1 by controlling the gelatin content. Further, a nucleating agent (compound (41) set forth above) and one of the nucleation accelerators set forth in Table 2 were added thereto in amounts of $1.8\times10^{-4}$ mol and $4.2\times10^{-4}$ mol, respectively, per mol of silver to prepare a coating composition.

This composition was coated on a polyethylene-laminated paper. Concurrently with coating, an ultraviolet ray absorbing layer having the composition described below was coated on the emulsion layer, and further thereon was coated a protective layer having the composition described below.

| (Ultraviolet Ray Absorbing Layer) | |
|---|---|
| Gelatin | 1.60 g/m$^2$ |
| Colloidal Silver | 0.10 g/m$^2$ |
| (Protective Layer) | |
| Gelatin | 1.33 g/m$^2$ |
| Acryl-denatured copolymer of Polyvinyl Alcohol (denaturation degree: 17%; molecular weight: 20,000) | 0.17 g/m$^2$ |

TABLE 1

Composition of Green-Sensitive Layer

| Main Component | Amount Used |
|---|---|
| Emulsion A | Silver coverage 0.39 g/m$^2$ |
| Gelatin | 1.45 g/m$^2$ |
| Magenta coupler (e) | $4.6\times10^{-4}$ mol/m$^2$ |
| Color image stabilizer (f) | 0.14 g/m$^2$ |
| Solvent (g) | 0.42 g/m$^2$ |
| Nucleating agent (Compound (41)) | $1.8\times10^{-4}$ mol/mol Ag |
| Nucleating accelerators (set forth in Table 2) | $4.2\times10^{-4}$ mol/mol Ag |
| Development accelerator (x) | 32 mg/m$^2$ |

Green-Sensitive Spectral Sensitizing Dye

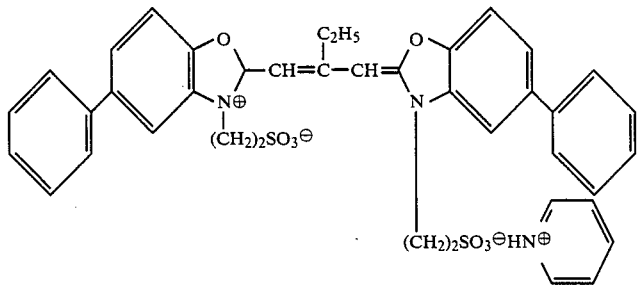

Anti-irradiation Dye for Green-Sensitive Emulsion Layer

TABLE 1-continued
| Composition of Green-Sensitive Layer | |
|---|---|
| Main Component | Amount Used |
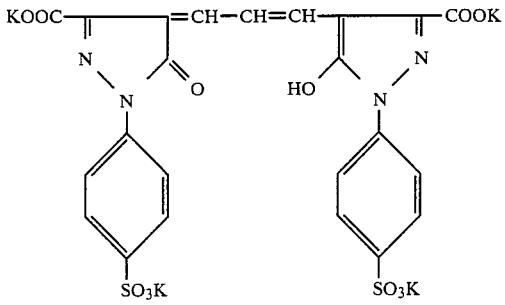
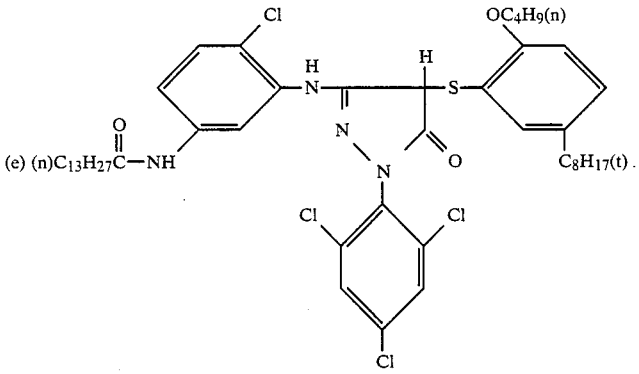
(f) 1:1.5 (by weight) mixture of
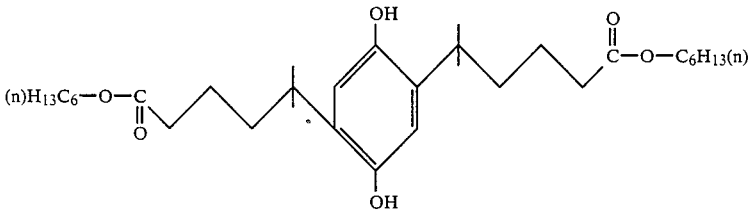
and
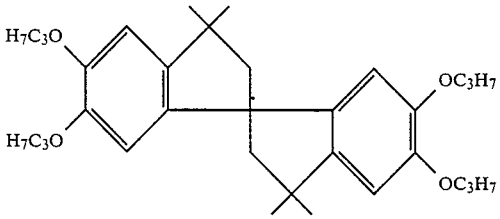
(g) 1:2:2 (by weight) mixture of
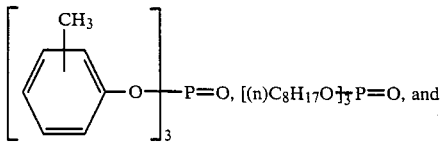

TABLE 1-continued

| Composition of Green-Sensitive Layer | |
|---|---|
| Main Component | Amount Used |

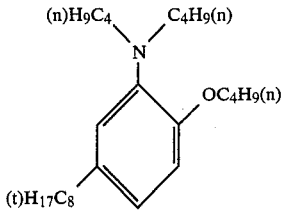

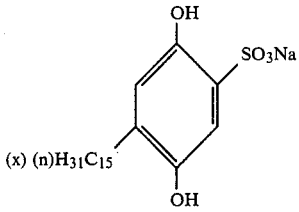

Samples of each of the thus prepared color photographic papers were subjected to wedge exposure (1/10 sec., 10 CMS) through a green filter (SP-2, made by Fuji Photo Film Co., Ltd.), and then either processed by the following processing step A (pH of the color developer used: 10.2), the following processing step B (pH of the color developer used: 11.2) or the following processing step C (pH of the color developer used: 12.0) independently, followed by measurement of color densities of developed magenta images.

The results obtained are shown in Table 2.

| Processing Step A | Time | Temperature |
|---|---|---|
| Color Development | 3 min. 30 sec. | 33° C. |
| Bleach-Fix | 1 min. 30 sec. | 33° C. |
| Stabilization (1) | 1 min. | 33° C. |
| Stabilization (2) | 1 min. | 33° C. |
| Stabilization (3) | 1 min. | 33° C. |

The stabilizing baths were replenished using a counter current replenishing method in which stabilizing bath (3) were replenished, the solution overflowing from stabilizing bath (3) were introduced into stabilizing bath (2), and the solution overflowing from stabilizing bath (2) was introduced into the stabilizing bath (1).

| (Color Developer) | |
|---|---|
| Diethylenetriaminepentaacetic Acid | 2.0 g |
| Benzyl Alcohol | 12.8 g |
| Diethylene Glycol | 3.4 g |
| Sodium Sulfite | 2.0 g |
| Sodium Bromide | 0.26 g |
| Hydroxylamine Sulfate | 2.60 g |
| Sodium Chloride | 3.20 g |
| 3-Methyl-4-amino-N—ethyl-N—(β-methane-sulfonamidoethyl)aniline | 4.25 g |
| Potassium Carbonate | 30.0 g |
| Brightening Agent (of stilbene-series) | 1.0 g |
| Water to make | 1,000 ml |
| pH adjusted to | 10.20 |

The pH of this solution was adjusted with potassium hydroxide or hydrochloric acid as required.

| (Bleach-fix Solution) | |
|---|---|
| Ammonium Thiosulfate | 110 g |
| Sodium Hydrogen Sulfite | 10 g |
| Ammonium Diethylenetriaminepentaacetato ferrate(III) Monohydrate | 56 g |
| Disodium Ethylenediaminetetraacetate Dihydrate | 5 g |
| 2-Mercapto-1,3,4-triazole | 0.5 g |
| Water to make | 1,000 ml |
| pH adjusted to | 6.5 |

The pH of the bleach-fix solution was adjusted with aqueous ammonia or hydrochloric acid, as required.

| (Stabilizing Solution) | |
|---|---|
| 1-Hydroxyethylidene-1,1'-diphosphonic Acid (60%) | 1.6 ml |
| Bismuth Chloride | 0.35 g |
| Polyvinylpyrrolidone (K-60) | 0.25 g |
| Aqueous Ammonia (27%) | 2.5 ml |
| Trisodium Nitrilotriacetate | 1.0 g |
| 5-Chloro-2-methyl-4-isothiazoline-3-one | 50 mg |
| 2-Octyl-4-isothiazoline-3-one | 50 mg |
| Brightening Agent (of 4,4'-diamino-stilbene-series) | 1.0 g |
| Water to make | 1,000 ml |
| pH adjusted to | 7.5 |

The pH of the stabilizing solution was adjusted with potassium hydroxide or hydrochloric acid, as required.

Processing step B was the same as processing step A, except that the color development time was changed to 1 minute and 30 seconds, and the pH of the color developer was adjusted to 11.2.

Processing step C was the same as processing step B, except that the pH of the color developer was adjusted to 12.0.

TABLE 2

| No. | Nucleation Accelerator | Processing Step A Dmax | Processing Step A Dmin | Processing Step B Dmax | Processing Step B Dmin | Processing Step C Dmax | Processing Step C Dmin |
|---|---|---|---|---|---|---|---|
| 1 | *1 | 2.4 | 0.09 | 2.4 | 0.09 | 2.2 | 0.10 |
| 2 | 3 | 2.5 | 0.09 | 2.5 | 0.09 | 2.3 | 0.10 |
| 3 | 4 | 2.4 | 0.09 | 2.4 | 0.09 | 2.2 | 0.10 |
| 4 | 6 | 2.3 | 0.09 | 2.4 | 0.09 | 2.2 | 0.10 |
| 5 | 8 | 2.3 | 0.09 | 2.4 | 0.09 | 2.2 | 0.10 |
| 6 | 11 | 2.5 | 0.09 | 2.5 | 0.09 | 2.3 | 0.09 |
| 7 | 16 | 2.4 | 0.09 | 2.4 | 0.09 | 2.2 | 0.09 |
| 8 | 20 | 2.6 | 0.09 | 2.6 | 0.09 | 2.3 | 0.09 |
| 9 | 21 | 2.6 | 0.10 | 2.6 | 0.09 | 2.3 | 0.09 |
| 10 | 22 | 2.6 | 0.09 | 2.6 | 0.09 | 2.3 | 0.09 |
| 11 | 34 | 2.4 | 0.09 | 2.5 | 0.09 | 2.3 | 0.09 |
| 12 | 38 | 2.4 | 0.10 | 2.4 | 0.09 | 2.3 | 0.10 |
| 13 | 43 | 2.3 | 0.09 | 2.4 | 0.09 | 2.2 | 0.10 |
| 14 | 46 | 2.4 | 0.10 | 2.5 | 0.09 | 2.3 | 0.10 |
| 15 | 49 | 2.3 | 0.10 | 2.4 | 0.09 | 2.3 | 0.10 |
| 16 | 51 | 2.4 | 0.09 | 2.5 | 0.09 | 2.3 | 0.10 |
| 17 | absent | 0.5 | 0.15 | 0.7 | 0.09 | 1.1 | 0.15 |
| 18 | **Compound-1 | 0.5 | 0.15 | 0.7 | 0.09 | 1.1 | 0.15 |
| 19 | Compound-2 | 0.5 | 0.15 | 0.7 | 0.09 | 1.1 | 0.15 |
| 20 | Compound-3 | 0.5 | 0.15 | 0.7 | 0.09 | 1.1 | 0.15 |

*Compound numbers of the nucleation accelerators set forth above.
**Compound-1

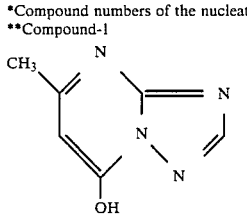

Compound-2

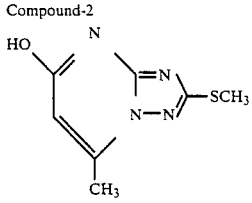

Compound-3

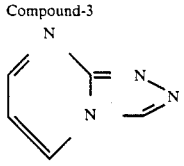

As can be seen from the data in Table 2, maximum color densities of the developed magenta images were increased, and minimum color densities were decreased in the systems using the nucleation accelerators in accordance with the present invention, compared with the system without a nucleation accelerator and the systems using comparable nucleation accelerators without the required mercapto group.

EXAMPLE 2

An integral multilayer color photographic paper was prepared using the core/shell-form, internal latent-image type emulsion B and coating layers so as to have the layer structure described in Table 3 on a paper support laminated with polyethylene on both sides thereof. The coating compositions used were prepared in the following manner.

Preparation of Coating Composition for First Layer

To 6.4 g of the cyan coupler (a) and 2.3 g of the color image stabilizer (b) shown below were added 10 ml of ethyl acetate and 4 ml of the solvent (c) shown below to prepare a solution. The solution was dispersed, in an emulsified condition, into 90 ml of a 10% aqueous gelatin solution containing 5 ml of a 10% solution of sodium dodecylbenzenesulfonate. Separately, the red-sensitive spectral sensitizing dye having the chemical structure illustrated below was added to the foregoing silver halide emulsion B (containing 70 g of Ag per kg of emulsion) in an amount of $2.0\times10^{-4}$ mole per mole of silver halide to prepare 90 g of a red-sensitive emulsion. The foregoing emulsified dispersion was mixed with the red-sensitive emulsion, and dissolved thereinto. Then, the resulting emulsion was so adjusted as to have the composition shown in Table 3 by controlling the gelatin content. Further, a nucleating agent (compound (50) set forth above) and one of the nucleation accelerators set forth in Table 4 were added thereto in amounts of $3.7\times10^{-5}$ mol and $3.0\times10^{-4}$ mol, respectively, per mol of silver to prepare the coating composition for the first layer.

Coating compositions for second to seventh layers were prepared in the same manner that of the first layer. In each of the layers, sodium salt of 1-oxy-3,5-dichloro-s-triazine was used as gelatin hardener in an amount of 1 wt% based on the total weight of gelatin.

TABLE 3

| Layer | Main Ingredients | Amount Used |
|---|---|---|
| 7th Layer (Protective layer) | Gelatin | 1.33 g/m$^2$ |
| | Acryl-denatured polyvinyl alcohol (denaturing degree: 17%, molecular weight 20,000) | 0.17 g/m$^2$ |
| | Polymethylmethacrylate particle (particle size 2.8 μm) | 0.05 g/m$^2$ |
| 6th Layer (Ultra-violet ray absorbing layer) | Gelatin | 0.54 g/m$^2$ |
| | Ultraviolet ray absorbent (h) | 5.10 × 10$^{-4}$ mol/m$^2$ |
| | Solvent (j) | 0.08 g/m$^2$ |
| 5th Layer (Blue-sensitive emulsion layer) | Emulsion B silver: | 0.40 g/m$^2$ |
| | Gelatin | 1.35 g/m$^2$ |
| | Yellow coupler (k) | 6.91 × 10$^{-4}$ mol/m$^2$ |
| | Color image stabilizer (l) | 0.13 g/m$^2$ |
| | Solvent (m) | 0.02 g/m$^2$ |
| | Nucleating agent | 3.7 × 10$^{-5}$ mol/mol Ag |
| | Nucleation accelerator | 3.0 × 10$^{-4}$ mol/mol Ag |
| 4th Layer (Ultra-violet ray absorbing layer) | Gelatin | 1.60 g/m$^2$ |
| | Colloidal silver (particle diameter 100Å) | 0.10 g/m$^2$ |
| | Ultraviolet ray absorbent (h) | 1.70 × 10$^{-4}$ mol/m$^2$ |
| | Color stain inhibitor (i) | 1.60 × 10$^{-4}$ mol/m$^2$ |
| | Solvent (j) | 0.24 g/m$^2$ |
| 3rd Layer (Green-sensitive emulsion layer) | Emulsion B silver: | 0.39 g/m$^2$ |
| | Gelatin | 1.56 g/m$^2$ |
| | Magenta coupler (e) | 4.60 × 10$^{-4}$ mol/m$^2$ |
| | Color image stabilizer (f) | 0.14 g/m$^2$ |
| | Solvent (g) | 0.42 g/m$^2$ |
| | Nucleating agent | 3.7 × 10$^{-5}$ mol/mol Ag |
| | Nucleation accelerator | 3.0 × 10$^{-4}$ mol/mol Ag |
| 2nd Layer (Color stain inhib-iting layer | Gelatin | 0.90 g/m$^2$ |
| | Color stain inhibitor (d) | 2.33 × 10$^{-4}$ mol/m$^2$ |

TABLE 3-continued

| Layer | Main Ingredients | Amount Used |
|---|---|---|
| 1st Layer (Red-sensitive emulsion layer) | Emulsion B silver: | 0.39 g/m$^2$ |
| | Gelatin | 0.90 g/m$^2$ |
| | Cyan coupler (a) | 7.05 × 10$^{-4}$ mol/m$^2$ |
| | Color image stabilizer (b) | 5.20 × 10$^{-4}$ mol/m$^2$ |
| | Solvent (c) | 0.22 g/m$^2$ |
| | Nucleating agent | 3.7 × 10$^{-5}$ mol/mol Ag |
| | Nucleation accelerator | 3.0 × 10$^{-4}$ mol/mol Ag |
| Support | Polyethylene-laminated paper (containing white pigment ($TiO_2$) and bluish pigment (ultramarine) in polyethylene laminate underneath the 1st layer in such an amount that a reflaction rate of light having a wavelength of 600 nm by the support became 90%) (thickness: 100 μm) | |
| Backing layer | Gelatin | 3.5 g/m$^2$ |
| 2nd Backing layer | Gelatin | 1.0 g/m$^2$ |
| | Polymethylmethacrylate particle (particle size 3.5 μm) | 0.08 g/m$^2$ |

The magenta coupler (e), the color image stabilizer (f), the solvent (g), the green-sensitive spectral sensitizing dye and the anti-irradiation dye employed in the third layer were the same as those described in Example 1. The other additives used were illustrated below.

Spectral sensitizing dyes used in the respective emulsion layers were as follows:

Blue-sensitive Emulsion Layer

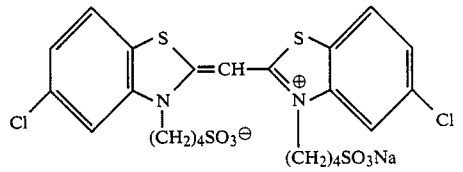

Red-sensitive Emulsion Layer

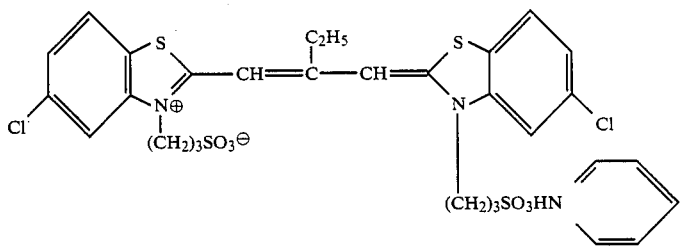

The following dye was used as the anti-irradiation dye in the red-sensitive emulsion layer:

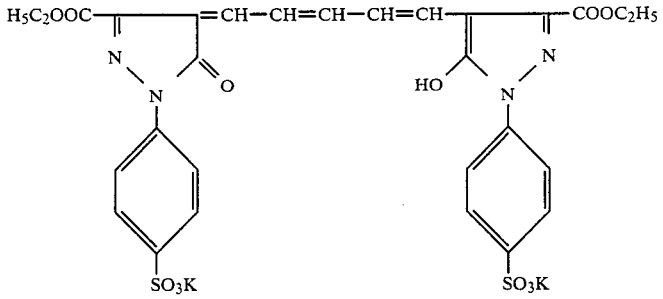
Structural formulae of the compounds, including couplers and so on, employed in this example are illustrated below.
(k) Yellow Coupler
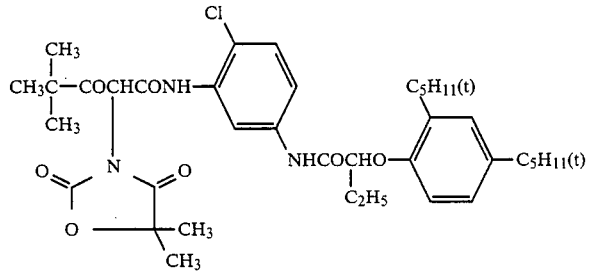
(l) Color Image Stablilzer
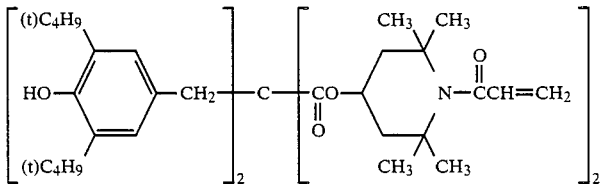
(m) Solvent
$$(\text{iso-}C_9H_{19}O)_3P{=}O$$
(h) Ultraviolet Ray Absorbent
1:5:3 (by mole) mixture of
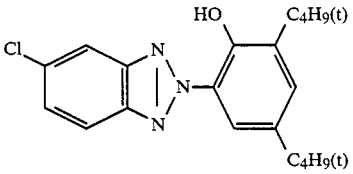
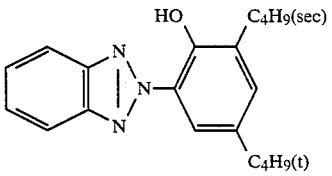
and -continued
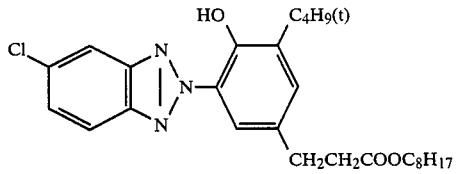
(i) Color Stain Inhibitor
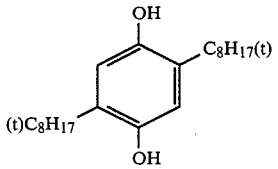
(j) Solvent
$(iso\text{-}C_9H_{19}O)_3P{=}O$
(a) Cyan Coupler
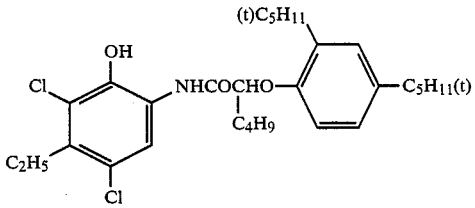
(b) Color Image Stabilizer
1:3:3 (by mole) mixtire of
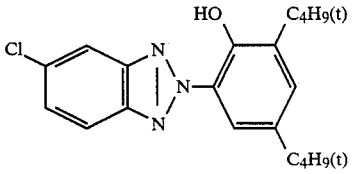
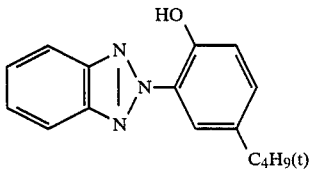
and
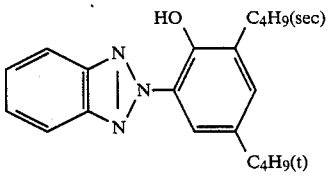
(c) Solvent
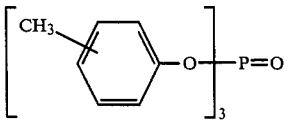
(d) Color Stain Inhibitor -continued

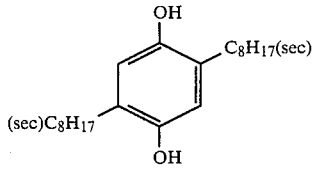

The fifth layer, the third layer and the first layer each contained 32 mg/m$^2$ of the development accelerator (x) illustrated in Example 1.

After the respective surface tensions and viscosities were equalized, the coating compositions for the first to the seventh layers were coated simultaneously to prepare an integral multilayer color photographic paper.

The thus prepared color photographic paper Nos. 1 to 16 were exposed and processed in the same steps and under the same conditions as employed in Example 1. The results obtained with respect to the final magenta color images are shown in Table 4.

TABLE 4

| No. | Nucleation Accelerator | Processing Step A Dmax | Processing Step A Dmin | Processing Step B Dmax | Processing Step B Dmin | Processing Step C Dmax | Processing Step C Dmin |
|---|---|---|---|---|---|---|---|
| 1 | *2 | 2.4 | 0.09 | 2.5 | 0.10 | 2.2 | 0.10 |
| 2 | 3 | 2.4 | 0.09 | 2.5 | 0.10 | 2.3 | 0.10 |
| 3 | 9 | 2.5 | 0.09 | 2.5 | 0.10 | 2.2 | 0.10 |
| 4 | 10 | 2.4 | 0.09 | 2.5 | 0.10 | 2.1 | 0.10 |
| 5 | 14 | 2.6 | 0.09 | 2.6 | 0.09 | 2.2 | 0.09 |
| 6 | 18 | 2.4 | 0.09 | 2.5 | 0.10 | 2.3 | 0.10 |
| 7 | 19 | 2.4 | 0.09 | 2.5 | 0.10 | 2.2 | 0.10 |
| 8 | 20 | 2.6 | 0.09 | 2.6 | 0.09 | 2.3 | 0.09 |
| 9 | 22 | 2.6 | 0.09 | 2.6 | 0.09 | 2.4 | 0.09 |
| 10 | 24 | 2.4 | 0.09 | 2.5 | 0.10 | 2.3 | 0.10 |
| 11 | 34 | 2.4 | 0.09 | 2.4 | 0.10 | 2.2 | 0.10 |
| 12 | 36 | 2.5 | 0.09 | 2.5 | 0.10 | 2.2 | 0.10 |
| 13 | 41 | 2.4 | 0.09 | 2.5 | 0.10 | 2.2 | 0.10 |
| 14 | 51 | 2.4 | 0.09 | 2.5 | 0.10 | 2.2 | 0.10 |
| 15 | absent | 0.6 | 0.09 | 0.7 | 0.15 | 1.1 | 0.15 |
| 16 | **Compound-4 | 0.6 | 0.09 | 0.7 | 0.15 | 1.1 | 0.15 |

*Compound numbers of the nucleation accelerators set forth below.
**Compound-4

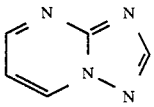

As can be clearly seen from the data in Table 4, advantages according to the invention similar to those obtained in Example 1 were also achieved when using the integral multilayer color photographic paper containing a red-sensitive emulsion layer, a green-sensitive emulsion layer and a blue-sensitive emulsion layer.

EXAMPLE 3

Sample Nos. 1 to 8 which had the same layer compositions and layer structure as the integral multilayer color photographic paper prepared in Example 2, except that modifications were made in the following respects, were prepared.

| Modifications | |
|---|---|
| (1) Internal latent image emulsion | The foregoing emulsion C in the same silver amount as the emulsion in Example 2 |
| (2) Nucleating agent | Compound (9) set forth above ($3 \times 10^{-5}$ mol/mol Ag) |
| (3) Nucleation accelerator | Those shown in Table 5, in the same amounts as in Example 2 |

-continued

| (4) Composition of the third layer (green-sensitive layer) | |
|---|---|
| Main Ingredients | Amount Used |
| Emulsion C | Silver 0.17 g/m$^2$ |
| Gelatin | 1.56 g/m$^2$ |
| Magenta coupler (e) | $3.38 \times 10^{-4}$ mol/m$^2$ |
| Color image stabilizer (f) | 0.19 g/m$^2$ |
| Nucleating agent | $3.0 \times 10^{-5}$ mol/m$^2$ |
| Nucleation accelerator | $3.0 \times 10^{-4}$ mol/m$^2$ |
| Solvent (g) | 0.59 g/m$^2$ |
| (5) Yellow coupler (k) | The compound illustrated below in the same amount as the yellow coupler in Example 2 |
| (6) Cyan coupler (a) | The compound illustrated below in the same amount as the cyan coupler in Example 2 |

(e) Magenta Coupler

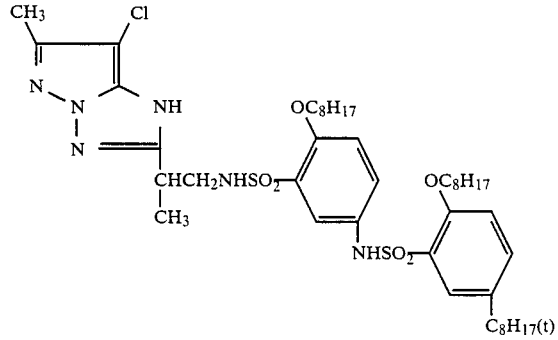

(f) Color Image Stabilizer

-continued

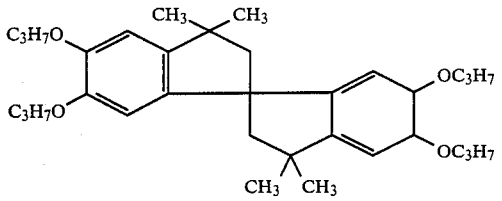

(g) Solvent

2:1 (by weight) mixture of

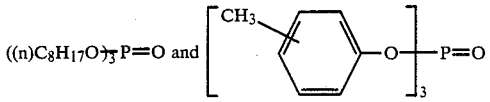

(k) Yellow Coupler

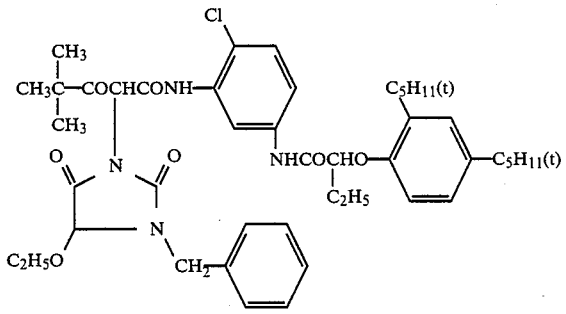

(a) Cyan Coupler

1:1 (by mole) mixture of

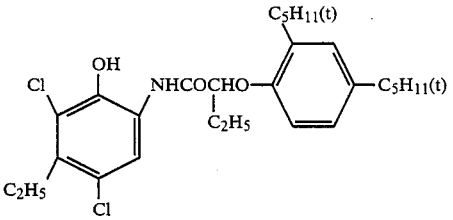

and

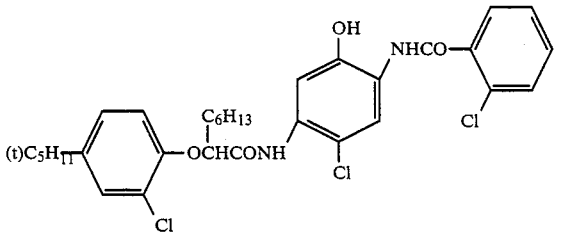

Samples of each of the thus-obtained color photographic paper Nos. 1 to 8 were subjected to wedge exposure through a red filter, and then either to processing step A, B or C as in Example 1, except that color developments in the processing steps A, B and C were carried out at 35° C. for 2 minutes, at 35° C. for 1 minute and at 35° C. for 1 minute, respectively, followed by measurement of color densities of developed cyan-color images. The results obtained are shown in Table 5.

TABLE 5

| No. | Nucleation Accelerator | Processing Step A Dmax | Processing Step A Dmin | Processing Step B Dmax | Processing Step B Dmin | Processing Step C Dmax | Processing Step C Dmin |
|---|---|---|---|---|---|---|---|
| 1 | *1 | 2.5 | 0.10 | 2.5 | 0.10 | 2.2 | 0.11 |
| 2 | 6 | 2.4 | 0.10 | 2.4 | 0.10 | 2.2 | 0.10 |
| 3 | 9 | 2.3 | 0.10 | 2.4 | 0.10 | 2.3 | 0.10 |
| 4 | 10 | 2.5 | 0.10 | 2.5 | 0.10 | 2.2 | 0.10 |
| 5 | 34 | 2.5 | 0.10 | 2.5 | 0.10 | 2.4 | 0.10 |
| 6 | 36 | 2.4 | 0.10 | 2.4 | 0.10 | 2.3 | 0.10 |
| 7 | 51 | 2.4 | 0.11 | 2.4 | 0.10 | 2.2 | 0.11 |
| 8 | absent | 0.4 | 0.13 | 0.8 | 0.14 | 1.1 | 0.15 |

*Compound numbers of the nucleation accelerators set forth above.

As can be clearly seen from the data in Table 5, Sample Nos. 1 to 7 containing the nucleation accelerator of the present invention each showed high Dmax and low Dmin as compared with those of Sample No. 8 containing no nucleation accelerator. The effects decreased in the order to Processing Step A (pH 10.2), Processing Step B (pH 11.2) and Processing Step C (pH 12.0).

EXAMPLE 4

A monolayer color photographic paper was prepared by the simultaneous coating of the same green-sensitive layer (the third layer), the same ultraviolet ray absorbing layer (the fourth layer) and the same protective layer (the seventh layer) as in Example 3, except modifications were made in the following respects:

| Modifications | |
|---|---|
| (1) Internal latent-image emulsion | The foregoing emulsion D in the same amount as the emulsion in Example 3. |
| (2) Nucleation accelerator | Added to the color developer in an amount of $3 \times 10^{-6}$ mol/l, instead of the photosensitive material |
| (3) Nucleating agent | Compound (50) set forth above ($3 \times 10^{-5}$ mol/mol Ag). |

The thus-obtained color photographic paper was subjected to wedge exposure through a green filter, and then to the same processing steps A, B and C independently as in Example 1, except the color developments in the processing steps A, B and C were carried out at 33° C. for 2 minutes and 30 seconds, followed by measurement of color densities of the final magenta images. The results obtained are shown in Table 6.

TABLE 6

| No. | Nucleation Accelerator | Processing Step A Dmax | Processing Step A Dmin | Processing Step B Dmax | Processing Step B Dmin | Processing Step C Dmax | Processing Step C Dmin |
|---|---|---|---|---|---|---|---|
| 1 | 3 | 2.1 | 0.12 | 2.2 | 0.13 | 2.1 | 0.13 |
| 2 | 6 | 2.2 | 0.12 | 2.3 | 0.13 | 2.2 | 0.13 |
| 3 | 10 | 2.1 | 0.12 | 2.2 | 0.13 | 2.2 | 0.13 |
| 4 | 20 | 2.1 | 0.12 | 2.3 | 0.13 | 2.2 | 0.13 |
| 5 | 34 | 2.1 | 0.12 | 2.2 | 0.13 | 2.2 | 0.13 |
| 6 | 36 | 2.2 | 0.12 | 2.2 | 0.13 | 2.2 | 0.13 |
| 7 | Absent | 0.6 | 0.13 | 0.8 | 0.14 | 1.4 | 0.15 |

As can be seen from the data in Table 6, the system utilizing the nucleation accelerators of the present invention were all excellent in maximum color density of the final magenta image compared with those without nucleation accelerators.

EXAMPLE 5

To the foregoing emulsion A was added compound (41) set forth above as a nucleating agent in an amount of $2.1\times10^{-4}$ mole per mole of silver halide. The resulting emulsion was divided into several portions, and thereto were added nucleation accelerators shown in Table 7, respectively. They were coated on separate polyethylene terephthalate supports as a silver coverage of 3.0 g/m$^2$. Gelatin protective layers (coverage 1.0 g/m$^2$) were simultaneously coated on the respective emulsion layers to prepare direct positive black-and-white photographic materials.

These samples were exposed for 1 second by means of a tungsten lamp of 1 KW at a color temperature of 2854° K. through a step wedge, developed at 30° C. for 1 minute using the developer D prepared by mixing 1 liter of the following replenisher A and 20 ml of the following starter B and an automatic developing machine (camera processor Model FMCP-4800, produced by Fuji Photo Film Co., Ltd.), and then subjected successively to conventional stop, fixation, washing and drying processing. The thus processed samples were examined for maximum density (Dmax) and sensitivity. The results obtained are shown in Table 7.

| Replenisher A | |
|---|---|
| Sodium Sulfite | 100 g |
| Potassium carbonate | 20 g |
| 1-Phenyl-4-methyl-4-hydroxymethyl-3-pyrazolidone | 3 g |
| Hydroquinone | 45 g |
| 5-Methylbenzotriazole | 40 g |
| Water to make | 1 liter |

The pH was adjusted to 11.2 with potassium hydroxide.

| Starter B | |
|---|---|
| Sodium Bromide | 175 g |
| Glacial Acetic Acid | 63 ml |
| Water to make | 1 liter |

TABLE 7

| No. | *(1)Nucleation Accelerator | Dmax | Note |
|---|---|---|---|
| 1 | *(2)2 | 2.80 | Invention |
| 2 | 6 | 2.82 | Invention |
| 3 | 9 | 2.79 | Invention |
| 4 | 17 | 2.75 | Invention |
| 5 | 34 | 2.70 | Invention |
| 6 | not added | 2.10 | Comparison |

*(1)Amount used: $4\times10^{-4}$ mol/mol Ag.
*(2)Compound numbers of the nucleation accelerators set forth above.

As can be seen from the results in Table 7, black-and-white images produced by the present invention, from No. 1 to No. 5, were superior to the comparative sample No. 6, with respect to the maximum density of the positive image obtained.

EXAMPLE 6

Samples were prepared in the same manner as in Example 5, except that compound (50) set forth above was used as a nucleating agent, and the compounds set forth in Table 8 were used as nucleation accelerators. These samples were processed in the same manner as in Example 5, except that development temperature was raised to 32° C., and the maximum densities of the positive images produced were determined. The results obtained are shown in Table 8.

TABLE 8

| No. | Nucleation Accelerator | Dmax | Note |
|---|---|---|---|
| 1 | (*)3 | 2.63 | Invention |
| 2 | 14 | 2.62 | Invention |
| 3 | 20 | 2.59 | Invention |
| 4 | 24 | 2.61 | Invention |
| 5 | 46 | 2.61 | Invention |
| 6 | not added | 1.60 | Comparison |

(*)Compound numbers of the nucleation accelerators set forth above.

The amounts of the nucleation accelerators used were the same as in Example 5.

As can be clearly seen from the data in Table 8, the maximum densitites of the positive images produced were much higher in the samples of the present invention, from No. 1 to No. 5, than in the comparative sample No. 6.

EXAMPLE 7

On a black polyethylene terephthalate support, 100 μm thick were coated the layers described below, from (1) to (11), in this order to prepare a photosensitive sheet.

(1) Layer containing a cyan DRR compound of the structural formula shown below (0.36 mmol/m$^2$), tricyclohexyl phosphate (0.09 g/m$^2$), 2,5-di(t-pentadecyl)hydroquinone (0.01 g/m$^2$) and gelatin (0.44 g/m$^2$):

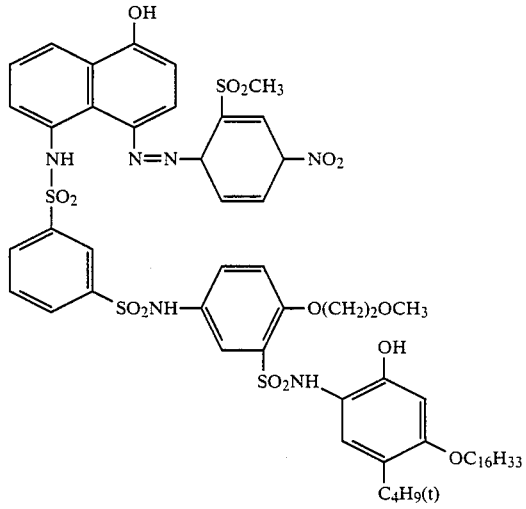

(2) Layer containing a red-sensitive internal latent image type direct reversal silver bromide emulsion (the foregoing emulsion A containing $1.5\times10^{-4}$ mol/mol Ag of the same red-sensitive spectral sensitizing dye as used in Example 2 and 0.5 g/m$^2$ of silver), gelatin (0.78 g/m$^2$), a nucleating agent of the structural formula shown below (27 μg/m$^2$) and sodium pentadecylhydroquinonesulfonate (0.06 g/m$^2$):

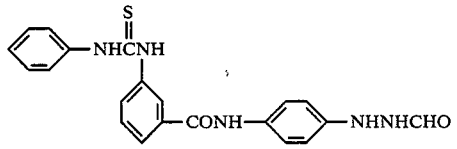

(3) Layer containing 2,5-di(tert-pentadecyl)hydroquinone (0.71 g/m$^2$), polymethylmethacrylate (molecular weight, 20,000) (0.70 g/m$^2$) and gelatin (0.4 g/m$^2$).

(4) Layer containing gelatin (0.3 g/m$^2$).

(5) layer containing a magenta DRR compound of the structural formula shown below (0.49 g/m$^2$), tricyclohexyl phosphate (0.08 g/m$^2$), 2,5-di(tert-pentadecyl)hydroquinone (0.01 g/m$^2$) and gelatin (0.5 g/m$^2$):

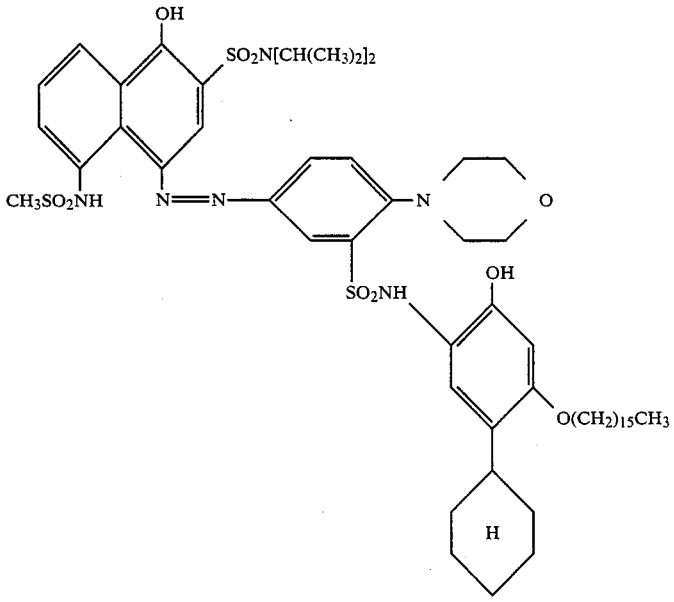

(6) Layer containing a green-sensitive internal latent image type direct reversal silver bromide emulsion (the foregoing emulsion A containing $2.1\times10^{-4}$ mol/mol Ag of the same green-sensitive spectral sensitizing dye as used in Example 2, and 0.34 g/m$^2$ of silver), gelatin (0.66 g/m$^2$), the same nucleating agent as in the above layer (2) (12.9 μg/m$^2$) and sodium pentadecylhydroquinonesulfonate (0.04 g/m$^2$).

(7) Layer containing 2,5-di(tert-pentadecyl)hydroquinone (0.71 g/m$^2$), polymethylmethacrylate (molecular weight, 20,000) (0.70 g/m$^2$) and gelatin (0.4 g/m$^2$).

(8) Layer containing gelatin (0.25 g/m$^2$).

(9) Layer containing a yellow DRR compound of the structural formula shown below (0.48 g/m$^2$), tricyclohexyl phosphate (0.03 g/m$^2$), 2,5-di(tert-pentadecyl)hydroquinone (0.004 g/m$^2$) and gelatin (0.43 g/m$^2$):

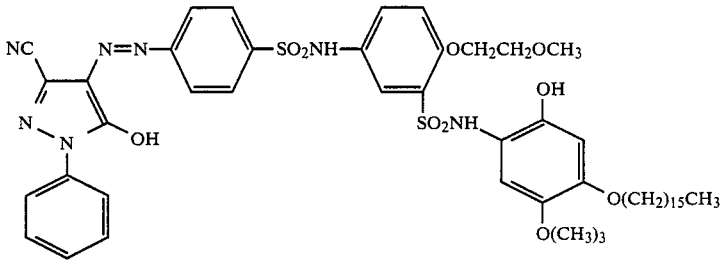

(10) Layer containing a blue-sensitive internal latent image type direct reversal silver bromide emulsion (the foregoing emulsion A containing $2.1\times10^{-4}$ mol/mol Ag of the same blue-sensitive spectral sensitizing dye, as used in Example 2, and 0.84 g/m$^2$ of silver), gelatin (0.9 g/m$^2$), the same nucleating agents as used in layer (2) above (29 mg/m$^2$) and sodium pentadecylhydroquinonesulfonate (0.05 g/m$^2$).

(11) Layer containing gelatin (1.0 g/m$^2$).

A 0.8 g portion of a processing solution having the following composition was charged into a rupturable container.

| Processing Solution | |
|---|---|
| Benzyl Alcohol | 0.20 ml |
| 1-(p-Tolyl)-4-hydroxymethyl-4-methyl-3-pyrazolidone | 0.3 g |
| Methylhydroquinone | 0.012 g |
| 5-Methylbenzotriazole | 0.6 g |
| Sodium Sulfite | 0.18 g |
| Hydroxymethyl Cellulose | 4 g |
| Potassium Hydroxide (28% aq. soln.) | 22.4 ml |
| Water | 67 ml |

On one side of white support, the opposite side of which was coated with a carbon black layer (3.0 g/m$^2$) and a titanium white layer (1.0 g/m$^2$) in this order, were coated the layers (12) to (16) described below in this order to prepared a dye image-receiving sheet.

(12) Layer containing an acrylic acid/butyl acrylate (80/20, by weight) copolymer (22 g/m$^2$) and 1,4-bis(2,3-epoxypropoxy)butane (0.44 g/m$^2$).

(13) Layer containing acetyl cellulose (which produced 39.4 g of the acetyl group by hydrolysis of a 100 g portion thereof) (3.8 g/m$^2$) (molecular weight 20,000), a styrene/maleic anhydride (60/40, by weight) copolymer having a molecular weight of about 50,000 (0.2 g/m$^2$) and 5-($\beta$-cyanoethylthio)-1-phenyltetrazole (0.115 g/m$^2$).

(14) Layer containing a vinylidene chloride/methylacrylate/acrylic acid (85/12/3, by weight) copolymer latex (particle size: 0.03 $\mu$m) (2.5 g/m$^2$) and a polymethylmethacrylate latex (particle size: 1 to 3 microns) (0.05 g/m$^2$).

(15) Layer containing a mordant of the structural formula shown below (molecular weight: 20,000) (3.0 g/m$^2$) and gelatin ( 3.0 g/m$^2$):

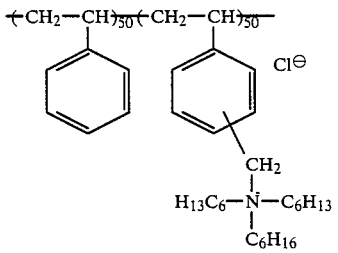

(16) Layer containing phthaloylated gelatin (1 g/m$^2$).

The above-described photosensitive sheet was named Sample A, and Samples B, C and D were further prepared by incorporating the nucleation accelerators 3, 9 and 32 set forth above, respectively, in an amount of $3.0\times10^{-5}$ mol/mol Ag into the layers (2), (6) and (10) of Sample A.

After optical exposure, Samples A, B, C and D each were brought into a face-to-face contact with the above-described dye image-receiving sheet, and pressure was applied so as to spread the foregoing processing solution in a 60 $\mu$m-thick layer between the photosensitive sheet and the image-receiving sheet. After allowed to stand for 90 seconds at 25° C., both sheets were peeled apart. As a result, transferred color images were obtained.

The results of sensitometry tests are shown in Table 9.

TABLE 9

| | Nucleation Accelerator added to Emulsion Layers | Red Density Dmax | Red Density Dmin | Green Density Dmax | Green Density Dmin | Blue Density Dmax | Blue Density Dmin |
|---|---|---|---|---|---|---|---|
| Sample A | not added (Comparison) | 2.20 | 0.17 | 2.21 | 0.150 | 2.15 | 0.130 |
| Sample B* | 3 | 2.70 | 0.17 | 2.60 | 0.150 | 2.60 | 0.130 |
| Sample C | 9 | 2.80 | 0.17 | 2.62 | 0.150 | 2.58 | 0.130 |
| Sample D | 34 | 2.77 | 0.17 | 2.65 | 0.150 | 2.65 | 0.130 |

*Compound numbers of the nucleation accelerators set forth above.

The addition of the compounds in accordance with the present invention improved the maximum density of the red-sensitive layer (Red) to a great extent.

The results obtained in the foregoing Examples demonstrate that in accordance with the present invention, a direct-positive image with high maximum density and low minimum density can be formed rapidly and consistently.

In addition, by the present invention a direct-positive image having reduced rereversal negative image generation under high intensity exposure can be obtained.

Further, in the direct-positive images obtained, the maximum and minimum densities are little changed from their respective optimal values when variations occur in the temperature and pH of the developer used. Since such variations affect color reproducibility only slightly, excellent density valves and consistency can be attained in direct-positive color photosensitive materials.

Furthermore, direct-positive images having near-optimal maximum and minimum densities and consistent gradation are achieved despite deviation of the developing time from the standard.

In addition, even after long storage time, photosensitive materials can provide a direct-positive image without an appreciable decrease in maximum density and only a slight increase in minimum density.

Further, a direct-positive color image in which color reproducibility is little affected by deviation of the developing time from the standard can be obtained.

Furthermore, the developing solution used has reduced deterioration due to air oxidation and other causes, to provide more consistent results.

While the invention has been described in detail and with reference to specific embodiments thereof, it will be apparent to one skilled in the art that various changes and modifications can be made therein without departing from the spirit and scope thereof.

What is claimed is:

1. A process for forming a direct-positive image comprising the step of developing an imagewise exposed photosensitive material comprising a support and at least one photographic emulsion layer thereon containing nonprefogged silver halide grains capable of forming an internal latent image, said developing step being carried out in the presence of a combination of a nucleating agent and at least one compound having at least one mercapto group selected from a mercapto-tetrazaindene, a mercapto-triazaindene and a mercapto-pentazaindene, futher provided that the hydrogen atom of said mercapto group may be replaced by an alkali metal atom or an ammonium group wherein said nucleating agent is represented by the following general formula (N-I) or (N-II):

(N-I)

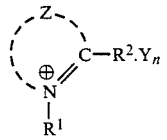

wherein Z represents a non-metallic atomic group necessary to complete an unsubstituted or substituted, 5-membered or 6-membered hetero ring; $R^1$ represents an unsubstituted or substituted aliphatic group; and $R^2$ represents a hydrogen atom, or an unsubstituted or substituted aliphatic or aromatic group; provided that at least one group selected from $R^1$, $R^2$, and Z may be substituted with an alkynyl group, an acyl group, a hydrazino group or a hydrazono group; and $R^1$ and $R^2$ may combine to form a 6-membered ring or a dihydropyridinium skeleton;

$$R^{21}-\underset{\underset{R^{23}}{|}}{N}-\underset{\underset{R^{24}}{|}}{N}-G-R^{22} \qquad \text{(N-II)}$$

wherein $R^{21}$ represents an aliphatic group, an aromatic group, or a heterocyclic group; $R^{22}$ represents a hydrogen atom, an alkyl group, an aralkyl group, an aryl group, an alkoxy group, an aryloxy group, or an amino group; G represents a carbonyl group, a sulfonyl group, a sulfoxy group, a phosphoryl group, or an iminomethylene group represented by $$HN{=}C\begin{matrix}/\\ \backslash\end{matrix};$$

$R^{23}$ and $R^{24}$ each represents a hydrogen atom or one of $R^{23}$ and $R^{24}$ represents a hydrogen atom and the other represents an alkysulfonyl group, an arylsulfonyl group or an acyl group, said nucleating agent being incorporated in said photosensitive material in an amount of from about $10^{-8}$ to $10^{-2}$ per mole of silver halide therein and said compound having at least one mercapto group being incorporated in said photosensitive material in an amount of from about $10^{-6}$ to $10^{-2}$ mole per mole of silver halide therein, the developing step being carried out at a pH of from about 10 to 11.5.

2. The process as claimed in claim 1, wherein said compound having at least one mercapto group is selected from the group consisting of 5H-pyrrolo[3,2-d]pyrimidine, a 1H-imidazo[4,5-b]pyridine, a 1H-pyrrolo[2,3-d]pyridazine, an s-triazolo[4,3-a]pyridine, an s-triazolo[1,5-a]pyrimidine, a 1H-imidazo[4,5-d]pyrimidine, an s-triazolo[4,3-a]pyrimidine, an s-triazolo[4,3-c]pyrimidine, an s-triazolo[4,3-b]pyridazine, a 1H-pyrazolo[3,4-d]pyrimidine, a v-triazolo[4,5-d]pyrimidine and a tetraazolo[1,5-a]pyrimidine.

3. The process as claimed in claim 2, wherein said compound having at least one mercapto group is selected from an s-triazolo[4,3-a]pyrimidine, an s-triazolo[1,5-a]pyrimidine, an s-triazolo[4,3-c]pyrimidine and an s-triazolo[4,3-b]pyridazine.

4. The process as claimed in claim 1, wherein said nucleating agent is incorporated in said photosensitive material in an amount of $10^{-7}$ to $10^{-3}$ mole per mole of silver halide therein and said compound having at least one mercapto group is incorporated in said photosensitive material in an amount of from about $10^{-5}$ to $10^{-2}$ mole per mole of silver halide therein.

5. The process as claimed in claim 1, wherein said nonprefogged silver halide grains comprise a silver halide selected from silver chloro(iodo)bromide, silver(iodo)chloride, and silver(iodo)bromide, this iodide content of said silver halide being about 3 mole% or less, the size of said grains is from about 0.1 μm to 2 μm, and said emulsion layer comprises a monodisperse silver halide emulsion having a grain size distribution such that at least about 90% of the grains therein have a size falling within a range of the number or weight average grain size about ±40%.

6. The process as claimed in claim 8, wherein said silver halide grain size is from about 0.15 μm to 1 μm and the grain size distribution of said monodisperse silver halide emulsion layer is such that at least about 95% of the grains therein have a size falling within a range of the number or weight average grain size about ±30%.

* * * * *